US007077087B2

(12) United States Patent
Tani

(10) Patent No.: US 7,077,087 B2
(45) Date of Patent: Jul. 18, 2006

(54) VALVE TIMING CONTROLLER

(75) Inventor: Hideji Tani, Kagamihara (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/109,935

(22) Filed: Apr. 20, 2005

(65) Prior Publication Data

US 2005/0235937 A1 Oct. 27, 2005

(30) Foreign Application Priority Data

Apr. 23, 2004 (JP) ..... 2004-128259
Mar. 10, 2005 (JP) ..... 2005-067415

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS

2005/0211207 A1* 9/2005 Urushihata et al. ..... 123/90.17

FOREIGN PATENT DOCUMENTS

JP 4-105906 9/1992

* cited by examiner

*Primary Examiner*—Thomas Denion
*Assistant Examiner*—Zelalem Eshete
(74) *Attorney, Agent, or Firm*—Nixon & Vanderhye P.C.

(57) ABSTRACT

A valve timing controller of a motor utilizing type has a control circuit for generating a control signal, and a driving circuit for turning-on and driving the motor in accordance with the control signal generated by the control circuit. The control circuit for receiving a motor rotation signal showing the real rotation speed of the motor, and an engine speed signal showing the real rotation speed of the engine generates the control signal on the basis of the motor rotation signal when the real rotation speed of the engine is less than a reference value. The control circuit also generates the control signal on the basis of the engine speed signal when the real rotation speed of the engine becomes the reference value or more.

17 Claims, 19 Drawing Sheets

| CONDITION | SIGNAL |
|---|---|
| Rcr<Rcrs | MOTOR SPEED SIGNAL |
| Rcr≧Rcrs | 1st·2nd ENGINE SPEED SIGNALS |

| CONDITION | SIGNAL |
|---|---|
| Rcr<Rcrs | MOTOR SPEED SIGNAL |
| Rcr≧Rcrs | 1st·2nd ENGINE SPEED SIGNALS<br>MOTOR SPEED SIGNAL |

VALVE TIMING CONTROLLER

CROSS-REFERENCE TO RELATED APPLICATION

This application is based on Japanese Patent Applications No. 2004-128259 filed on Apr. 23, 2004 and No. 2005-67415 filed on Mar. 10, 2005, the disclosure of which are incorporated herein by reference.

FIELD OF THE INVENTION

The present invention relates to a valve timing controller, which controls a valve timing of an intake valve and/or an exhaust valve of an internal combustion engine.

BACKGROUND OF THE INVENTION

JP-U-4-105906A shows a valve timing controller of an engine by utilizing a rotation torque of a motor. In the valve timing controller of such a motor utilizing type, a control signal is conventionally generated by a control circuit on the basis of an engine speed signal showing the real rotation speed of the engine, and the motor is electrically turned on and is driven by a driving circuit in accordance with this generated control signal. Here, a detecting signal of a rotation speed sensor for detecting the real rotation speed of the engine is used as the engine speed signal.

However, in the above controller, a detecting lower limit value inevitably exists in the rotation speed sensor of the engine. Therefore, when the real rotation speed of the engine is smaller than the detecting lower limit value, the detecting signal, i.e., the engine speed signal is not outputted from the rotation speed sensor. Therefore, when the real rotation speed of the engine becomes a low rotation speed smaller than the detecting lower limit value, the generation of the control signal using the control circuit and the electrical conducting operation of the motor using the driving circuit cannot be realized.

SUMMARY OF THE INVENTION

An object of the present invention is to provide a valve timing controller of the motor utilizing type able to suitably control the valve timing in accordance with the real rotation speed of the engine.

In accordance with the present invention, when the real rotation speed of the engine is less than a reference value, a control circuit generates a control signal on the basis of a motor rotation signal showing the real rotation speed or the real rotation position of the motor. Thus, even when the real rotation speed of the engine becomes a low rotation speed less than the reference value, the control signal is generated by the control circuit and an electric conducting operation of the motor according to this control signal can be realized by a driving circuit. When the real rotation speed of the engine becomes the reference value or more, the control circuit generates the control signal on the basis of an engine speed signal showing the real rotation speed of the engine. Thus, when the real rotation speed of the engine becomes a high rotation speed equal to or greater than the reference value, the generation of the control signal based on the engine speed signal and the electric conducting operation of the motor according to this control signal can be realized similarly to the conventional case. Accordingly, the valve timing can be appropriately adjusted in accordance with the real rotation speed of the engine.

BRIEF DESCRIPTION OF THE DRAWINGS

Other objects, features and advantages of the present invention will become more apparent from the following detailed description made with reference to the accompanying drawings, in which like parts are designated by like reference numerals and in which.

DESCRIPTION OF THE PREFERRED EMBODIMENTS

Embodiments of the present invention will next be explained on the basis of the drawings.

First Embodiment

Figure 2:
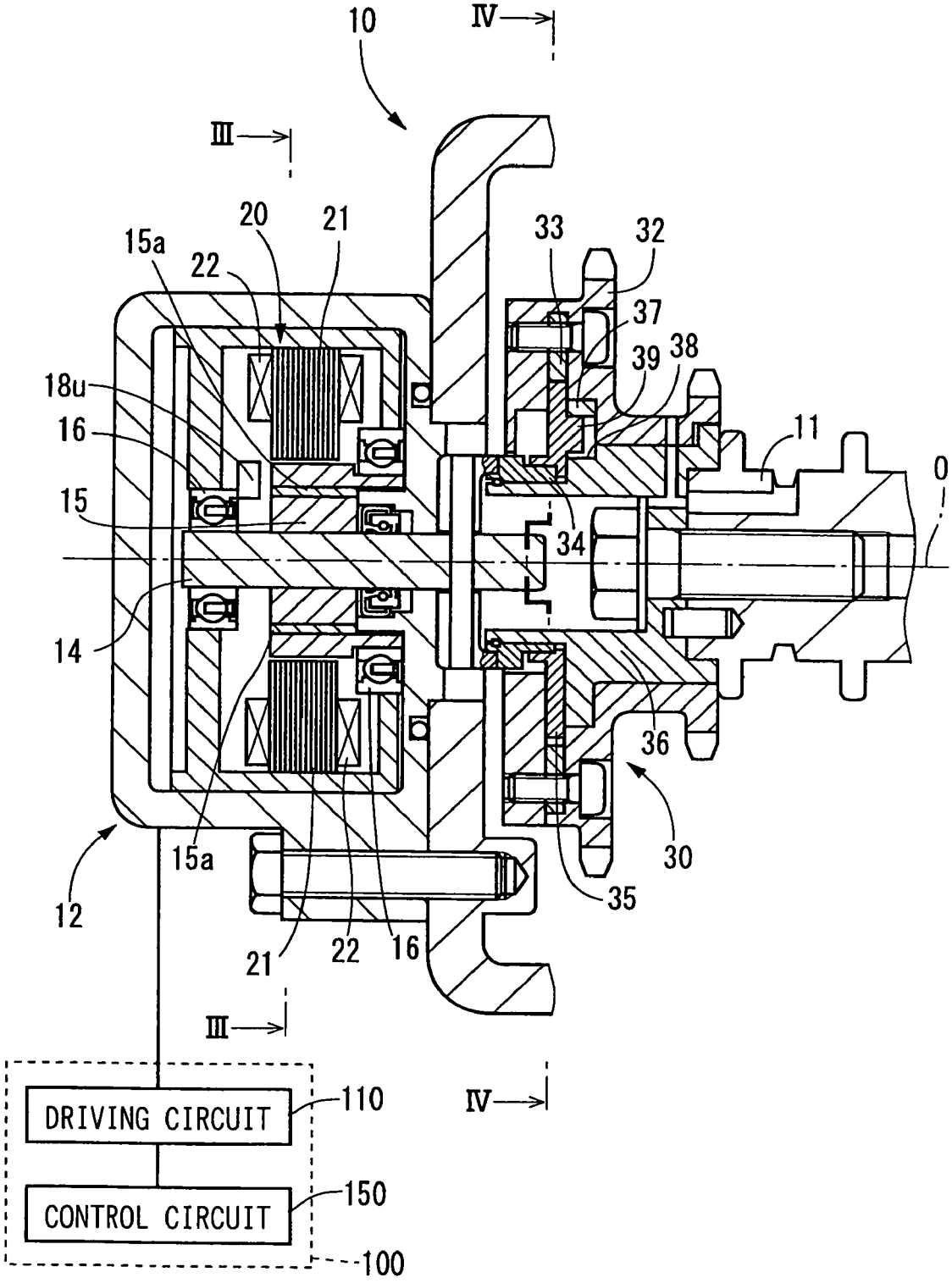
FIG. 2 is a cross-sectional view showing a valve timing controller in accordance with the first embodiment.
Figure 3:
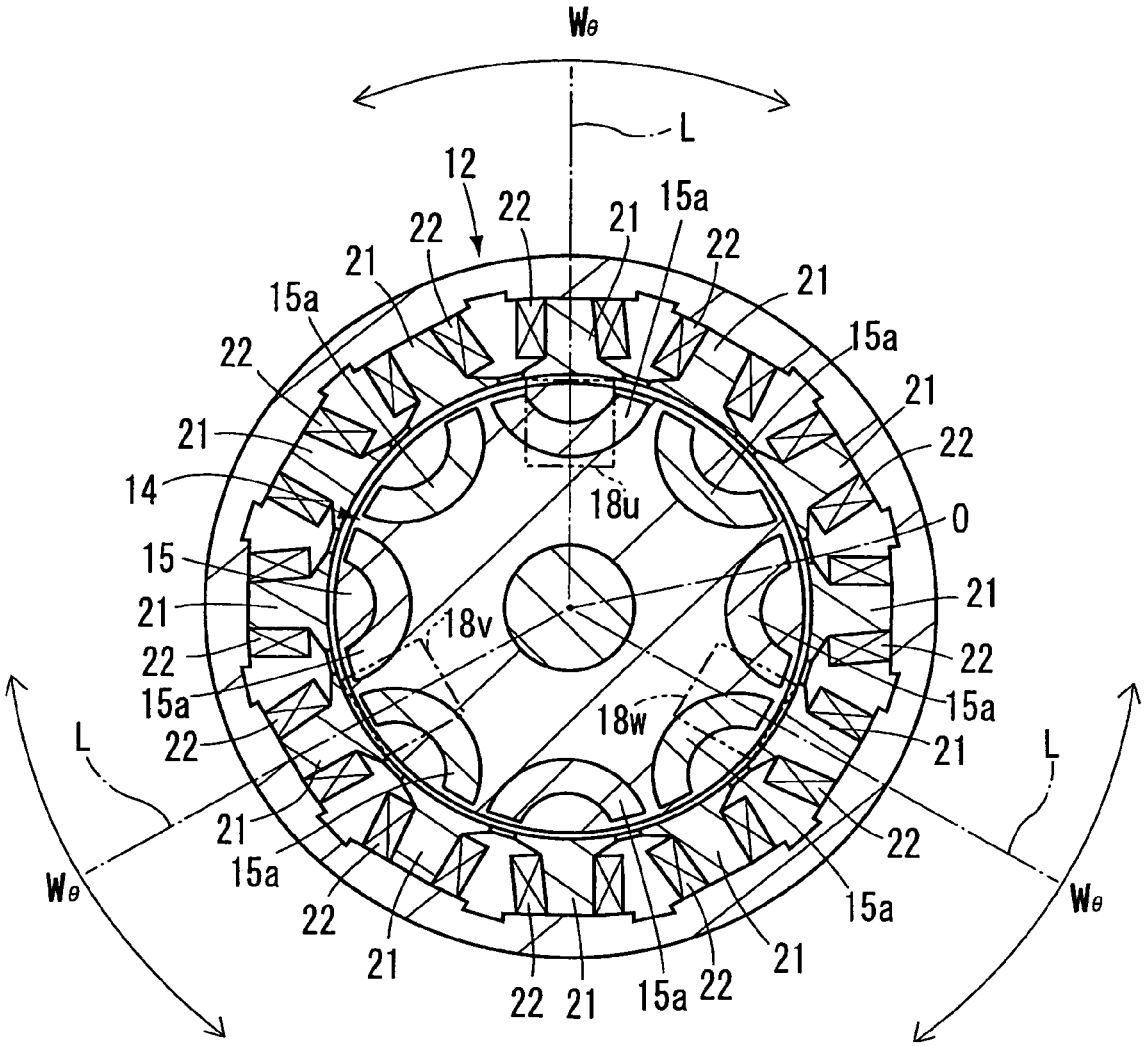
FIG. 3 is a cross-sectional view taken along line III—III of FIG. 2.
Figure 4:
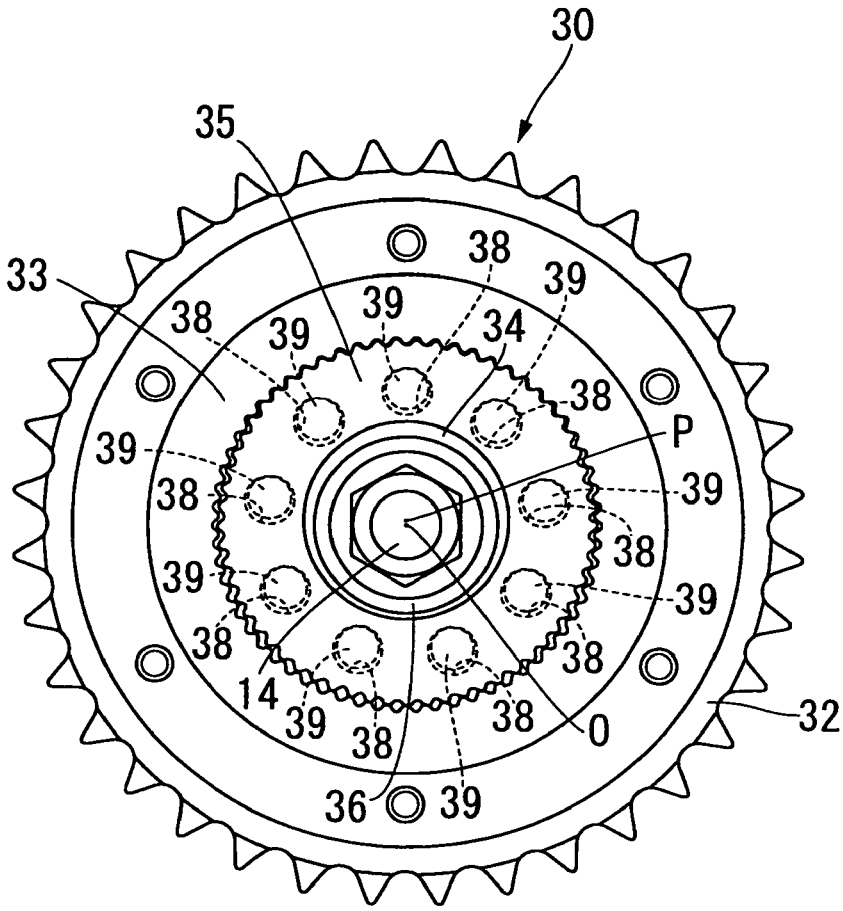
FIG. 4 is a cross-sectional view taken along line IV—IV of FIG. 2.

A valve timing controller in accordance with a first embodiment of the present invention is shown in FIGS. 2 to 4. The valve timing controller 10 additionally arranged in the engine of a vehicle adjusts valve timing with respect to an intake valve or an exhaust valve of the engine by utilizing the rotation torque of a motor 12.

As shown in FIGS. 2 and 3, the motor 12 of the valve timing controller 10 is a three-phase brushless motor having a motor shaft 14, a bearing 16, Hall effect elements 18*u*, 18*v*, 18*w* as rotation position sensors, and a stator 20.

The motor shaft 14 is supported by two bearings 16 and can be rotated in the normal and reverse directions around the axis O. In this embodiment, the clockwise direction of FIG. 3 among the rotating directions of the motor shaft 14 is set to the normal rotating direction, and the counterclockwise direction of FIG. 3 is set to the reverse rotating direction. The motor shaft 14 forms a rotor portion 15 of a disk shape projected from the shaft main body to the diametrical outside, and eight magnets 15*a* are buried in this rotor portion 15. Each magnet 15*a* is arranged at an equal interval around the axis O, and the magnets 15*a* adjacent to each other in the rotating direction of the motor shaft 14 are mutually reversely set with respect to a magnetic pole (hereinafter simply called a magnetic pole) formed on the outer circumferential wall side of the rotor portion 15.

Figure 5:
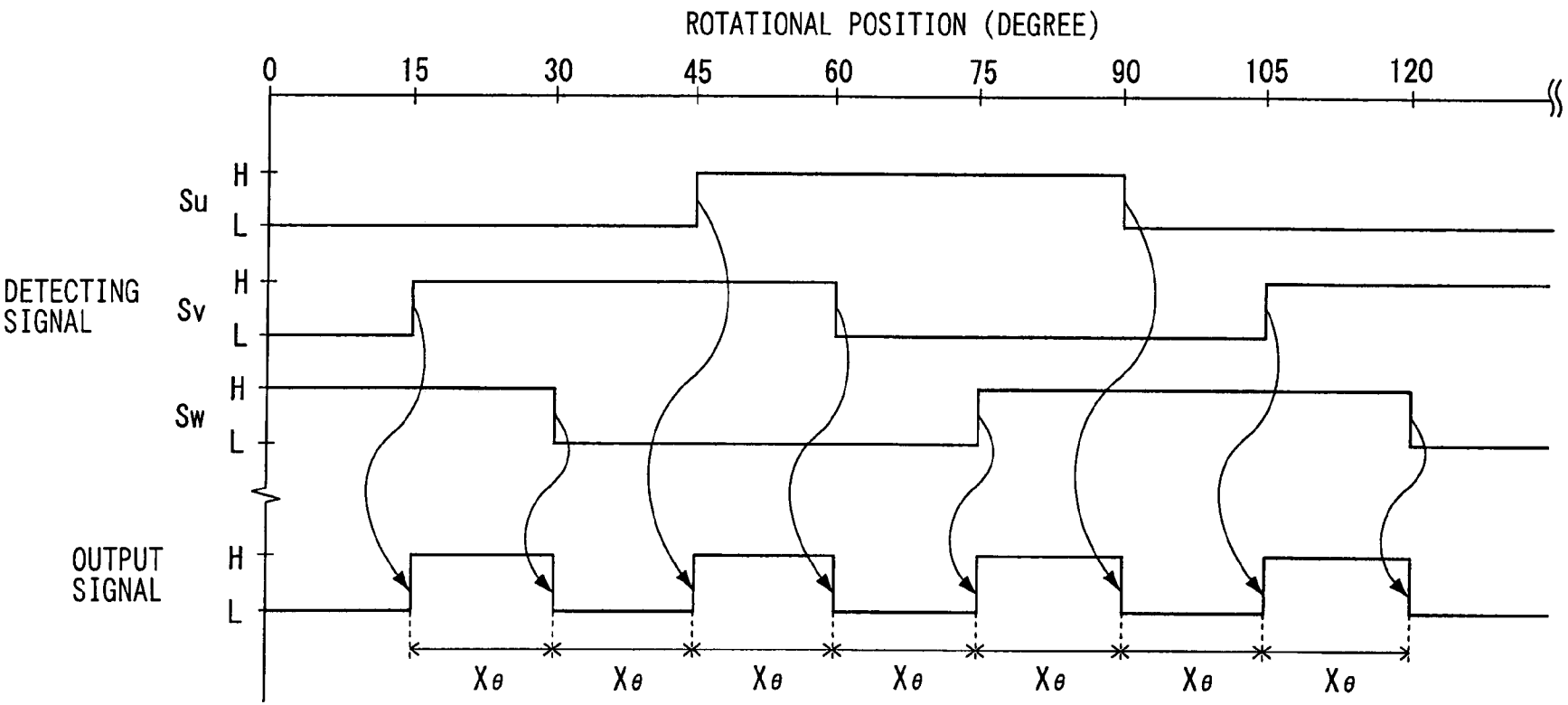
FIG. 5 is a typical view for explaining the operation of the motor controller in accordance with the first embodiment.

The three Hall effect elements 18*u*, 18*v*, 18*w* are arranged in the vicinity of the rotor portion 15 in a mode arranged at the equal interval around the axis O. Each of the Hall effect elements 18*u*, 18*v*, 18*w* detects the real rotating position θ of the motor shaft 14 in a determined angular range, and generates a detecting signal showing this real rotating position θ. FIG. 5 shows the detecting signal of each of the Hall effect elements 18*u*, 18*v*, 18*w* (briefly noted as Su, Sv, Sw). Concretely, as shown in FIG. 3, when the magnet 15*a* having the N-magnetic pole is located within an angular range $W_\theta$ of ±22.5° on both sides of the diametrical axis L passing each of the Hall effect elements 18*u*, 18*v*, 18*w*, each of the Hall effect elements 18*u*, 18*v*, 18*w* generates the detecting signal of a high (H) voltage level shown in FIG. 5. In contrast to this, when the magnet 15*a* having the S-magnetic pole is located within the angular range $W_\theta$ of ±22.5° on both the sides of the diametrical axis L, each of the Hall effect elements 18*u*, 18*v*, 18*w* generates the detecting signal of a low (L) voltage level as shown in FIG. 5. The detecting signal of each of the Hall effect elements 18*u*, 18*v*, 18*w* thus generated becomes a signal in which the voltage level is switched at different timings from each other in accordance with the real rotating position θ of the motor shaft 14.

Figure 6:
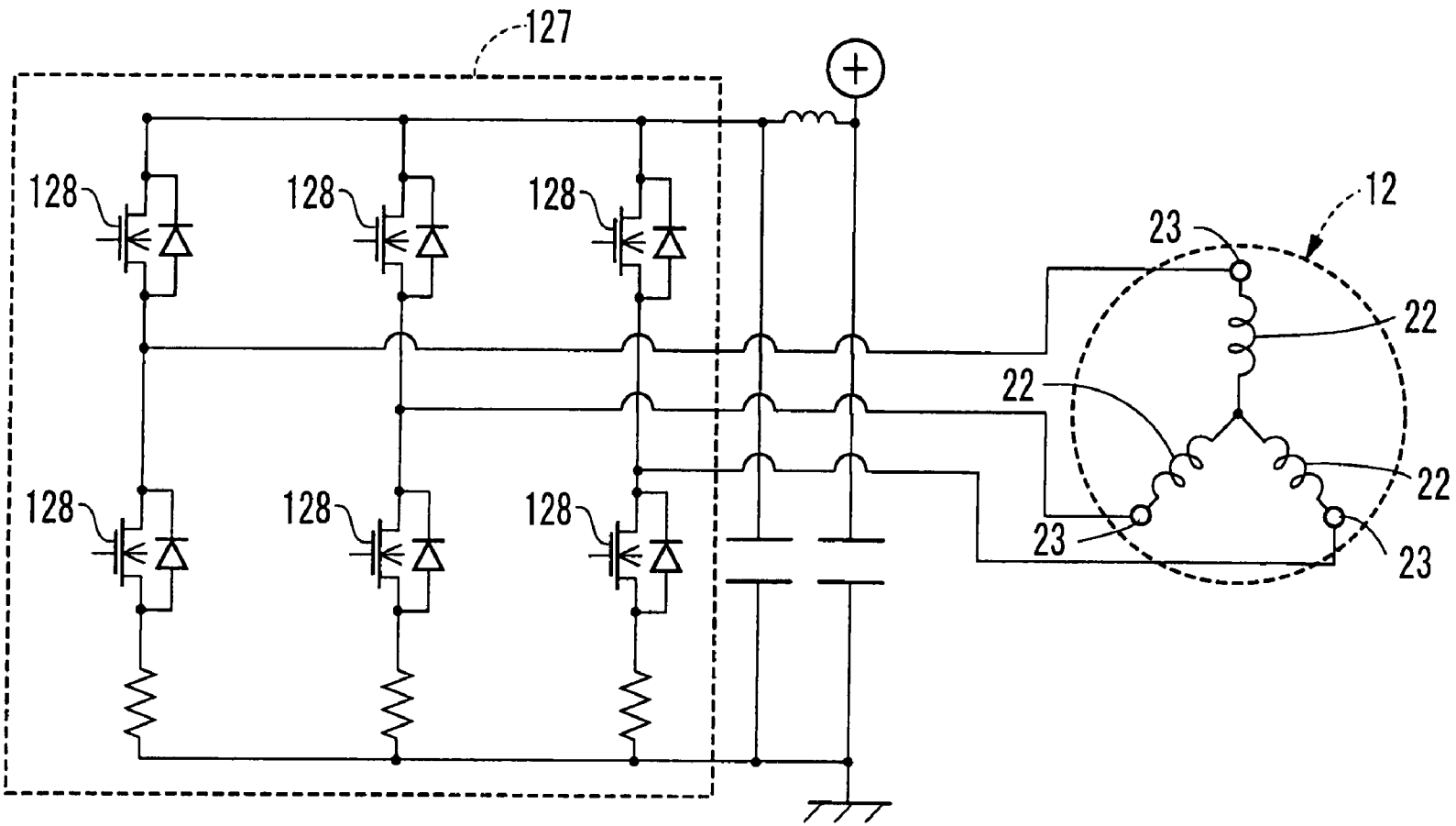
FIG. 6 is a circuit diagram showing the main portion of an electrical conducting portion in the first embodiment.

The stator 20 is arranged on the outer circumferential side of the motor shaft 14. Twelve cores 21 of the stator 20 are arranged at an equal interval around the axis O, and winding 22 is wound around each core 21. As shown in FIG. 6, the winding 22 is star-connected with three windings as one set. A terminal 23 connected to the non-connecting side is connected to a driving circuit 110 of a motor controller 100. A rotating magnetic field of the clockwise direction or the counterclockwise direction of FIG. 3 is formed on the outer circumferential side of the motor shaft 14 by flowing an electric current through each winding 22 by the driving circuit 110. When the rotating magnetic field of the clockwise direction of FIG. 3 is formed, the magnet 15*a* receives an interaction within this magnetic field and the rotation torque of the normal rotating direction is given to the motor shaft 14. The rotation torque of the reverse rotating direction is given to the motor shaft 14 by a similar principle when the rotating magnetic field of the counterclockwise direction of FIG. 3 is formed.

As shown in FIGS. 2 and 4, a phase changing mechanism 30 of the valve timing controller 10 has a sprocket 32, a ring gear 33, an eccentric shaft 34, a planetary gear 35 and an output shaft 36.

The sprocket 32 is coaxially arranged on the outer circumferential side of the output shaft 36, and can be relatively rotated around the same axis O as the motor shaft 14 with respect to the output shaft 36. When the driving torque of a crankshaft of the engine is inputted to the sprocket 32 through a chain belt, the sprocket 32 is rotated in the clockwise direction of FIG. 4 with the axis O as a center while holding a rotating phase with respect to the crankshaft. The ring gear 33 is constructed by an internal gear, and is coaxially fixed to the inner circumferential wall of the sprocket 32, and is rotated integrally with the sprocket 32.

The eccentric shaft 34 is connected and fixed to the motor shaft 14 so that the eccentric shaft 34 is arranged in a mode in which the outer circumferential wall of one end portion is eccentric with respect to the axis O. The eccentric shaft 34 can be rotated integrally with the motor shaft 14. The planetary gear 35 is constructed by an external gear, and is arranged so as to make a planetary movement on the inner circumferential side of the ring gear 33 such that one portion of plural teeth of the planetary gear 35 is engaged with one portion of plural teeth of the ring gear 33. The planetary gear 35 coaxially supported in the outer circumferential wall of the above one end portion of the eccentric shaft 34 can be relatively rotated around an eccentric axis P with respect to the eccentric shaft 34. The output shaft 36 is coaxially fixed to a camshaft 11 of the engine by a bolt, and is rotated integrally with the camshaft 11 with the same axis O as the motor shaft 14 as a center. An engaging portion 37 of an annular plate shape with the axis O as a center is formed in the output shaft 36. Nine engaging holes 38 are arranged at an equal interval around the axis O in the engaging portion 37. In the planetary gear 35, engaging projections 39 are projected from nine portions opposed to the respective engaging holes 38. Each engaging projection 39 is arranged at an equal interval around the eccentric axis P, and is projected into the corresponding engaging hole 38.

When the motor shaft 14 and the eccentric shaft 34 are not relatively rotated with respect to the sprocket 32, the planetary gear 35 is rotated integrally with the sprocket 32 in the clockwise direction of FIG. 4 while holding the engaging position with the ring gear 33 as the crankshaft is rotated. At this time, the engaging projection 39 presses against the inner circumferential wall of the engaging hole 38 in the rotating direction. Therefore, the output shaft 36 is rotated in the clockwise direction of FIG. 4 without being relatively rotated with respect to the sprocket 32. Thus, the rotating phase of the camshaft 11 with respect to the crankshaft, i.e., valve timing with respect to an intake valve or an exhaust valve operated by the camshaft 11 is held.

When the motor shaft 14 and the eccentric shaft 34 are relatively rotated in the counterclockwise direction of FIG. 4 with respect to the sprocket 32 by an increase in the rotation torque of the reverse rotating direction, etc., the engaging position of the planetary gear 35 with the ring gear 33 is changed while the planetary gear 35 is relatively rotated by the planetary movement in the clockwise direction of FIG. 4 with respect to the eccentric shaft 34. At this time, since force for pressing the engaging hole 38 in the rotating direction by the engaging projection 39 is increased, the output shaft 36 is angularly advanced with respect to the sprocket 32. Thus, the valve timing is changed to the angle advancing side.

When the motor shaft 14 and the eccentric shaft 34 are relatively rotated in the clockwise direction of FIG. 4 with respect to the sprocket 32 by an increase in the rotation torque of the normal rotating direction, etc., the engaging position of the planetary gear 35 with the ring gear 33 is changed while the planetary gear 35 is relatively rotated by the planetary movement in the counterclockwise direction of FIG. 4 with respect to the eccentric shaft 34. At this time, since the engaging projection 39 presses against the engaging hole 38 in the anti-rotating direction, the output shaft 36 is angularly retarded with respect to the sprocket 32. Thus, the valve timing is changed to the angle retarding side.

As shown in FIG. 2, the motor controller 100 of the valve timing controller 10 has the driving circuit 110 and a control circuit 150. In FIG. 2, the driving circuit 110 and the control circuit 150 are typically shown so as to be located in the exterior of the motor 12, but the respective arranging places of the driving circuit 110 and the control circuit 150 can be suitably set. For example, the driving circuit 110 may be arranged within the motor 12, and the control circuit 150 may be also arranged outside the motor 12. Otherwise, one portion of the driving circuit 110 may be arranged within the motor 12, and the remaining portion of the driving circuit 110 and the control circuit 150 may be also arranged outside the motor 12.

The control circuit 150 controls the electric conducting operation of the motor 12 using the driving circuit 110, and also controls the operation of the engine such as an igniting operation, a fuel injecting operation, and the like.

The control circuit 150 is constructed by an electric circuit such as a microcomputer. The control circuit 150 is connected to a first rotation speed sensor 160 for detecting the real rotation speed $R_{ca}$ of the camshaft 11, and receives a detecting signal of the first rotation speed sensor 160 showing the real rotation speed $R_{ca}$ of the camshaft 11 by a frequency as a first engine speed signal. The control circuit 150 is also connected to a second rotation speed sensor 162 for detecting the real rotation speed $R_{cr}$ of the crankshaft, and receives a detecting signal of the second rotation speed sensor 162 showing the real rotation speed $R_{cr}$ of the crankshaft by a frequency as a second engine speed signal. In this embodiment, the real rotation speed $R_{ca}$ of the camshaft 11 is about half the real rotation speed $R_{cr}$ of the crankshaft.

The control circuit 150 is further connected to a rotation signal generating section 120 of the driving circuit 110, and receives a motor rotation signal showing the real rotation speed $R_m$ of the motor shaft 14 from the rotation signal generating section 120 as described later. Here, the real rotation speed $R_m$ is a value provided by adding a sign showing the rotating direction to an absolute value showing its magnitude. This sign is set so as to be positive in the normal rotating direction and be negative in the reverse rotating direction.

The control circuit 150 generates a first control signal showing a target rotation speed $r_m$ of the motor shaft 14 and a second control signal showing a target rotating direction $d_m$ of the motor shaft 14 as control signals given to the driving circuit 110. Here, the target rotation speed $r_m$ is a value having no sign showing the rotating direction, and is an absolute value showing only the magnitude of the rotation speed. For example, a digital signal having a voltage, a duty ratio, a frequency, etc. proportional to such a target rotation speed $r_m$ is generated as the first control signal. For example, a digital signal having a voltage raised and lowered in accordance with the normal and reverse rotating directions is generated as the second control signal.

Figure 7:
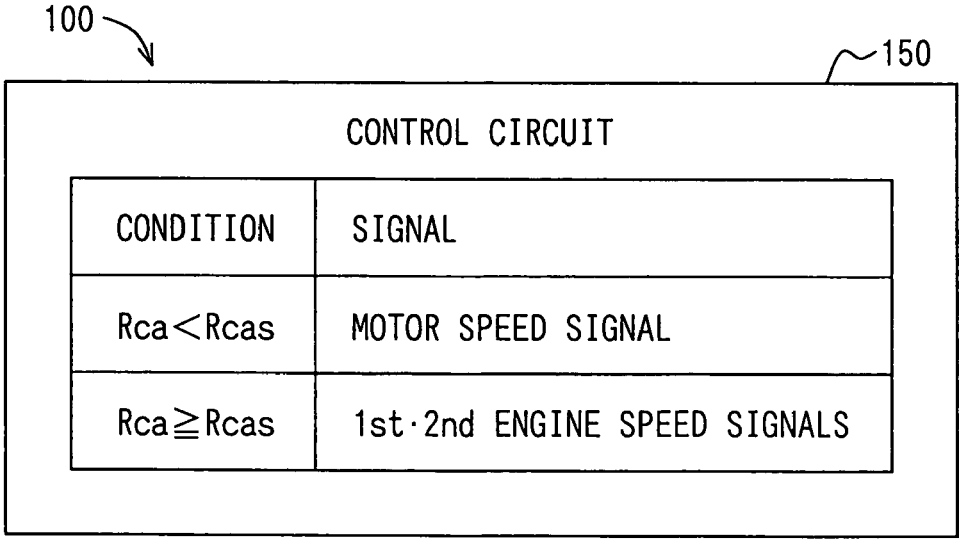
FIG. 7 is a typical view for explaining the operation of the motor controller in accordance with the first embodiment.

As shown in FIG. 7, the control circuit 150 of this embodiment switches a generating system of the control signal in accordance with the large and small relation of the real rotation speed $R_{ca}$ of the camshaft 11 shown by the received first engine speed signal and a predetermined reference value $R_{cas}$. Here, the reference value $R_{cas}$ is set to a value equal to or greater than detecting lower limit values of both the first and second rotation speed sensors 160, 162, and is stored to a memory of the control circuit 150 in advance.

The generating system of the control signal using the control circuit 150 will next be explained in detail.

When the real rotation speed $R_{ca}$ of the camshaft 11 shown by the first engine speed signal is less than the reference value $R_{cas}$, the control circuit 150 generates the first and second control signals on the basis of the received motor rotation signal as shown in FIG. 7. Concretely, the control circuit 150 calculates the real valve timing from the real rotation speed $R_m$ of the motor shaft 14 shown by the motor rotation signal, and sets target valve timing from a throttle aperture, oil temperature, etc. The control circuit 150 then determines a target rotation speed $r_m$ and a target rotating direction $d_m$ of the motor shaft 14 from the phase difference between the calculated real valve timing and the set target valve timing, and generates the first and second control signals so as to respectively show the target rotation speed $r_m$ and the target rotating direction $d_m$. Here, the correlation of the target rotation speed $r_m$ and the phase difference between the real valve timing and the target valve timing is stored to the memory of the control circuit 150 in advance, and the target rotation speed $r_m$ can be calculated in accordance with this correlation.

In contrast to this, when the real rotation speed $R_{ca}$ of the camshaft 11 shown by the first engine rotation speed becomes the reference value $R_{cas}$ or more, the control circuit 150 generates the first and second control signals on the basis of the received first and second engine speed signals as shown in FIG. 7. Concretely, the control circuit 150 calculates the real valve timing from the real rotation speed $R_{ca}$ of the camshaft 11 shown by the first engine speed signal and the real rotation speed $R_{cr}$ of the crankshaft shown by the second engine speed signal, and sets the target valve timing from the real rotation speed $R_{ca}$ of the camshaft 11 or the real rotation speed $R_{cr}$ of the crankshaft, the throttle aperture, the oil temperature, and the like. Similar to the case in which the real rotation speed $R_{ca}$ is less than the reference value $R_{cas}$, the control circuit 150 then generates the first and second control signals so as to respectively show the target rotation speed $r_m$ and the target rotating direction $d_m$ determined from the phase difference between the real valve timing and the target valve timing.

The driving circuit 110 turns on the motor 12 and drives the motor 12 in accordance with the first and second control signals.

The driving circuit 110 is constructed by an electric circuit, and has a rotation signal generating section 120, a feedback control section 124 and an electric conducting section 126.

The rotation signal generating section 120 is connected to the Hall effect elements 18*u*, 18*v*, 18*w*, and receives the detecting signal generated by each of the Hall effect elements 18*u*, 18*v*, 18*w*. The rotation signal generating section 120 is also connected to the control circuit 150, and generates the motor rotation signal showing the real rotation speed $R_m$ of the motor shaft 14, on the basis of the detecting signal of each of the Hall effect elements 18*u*, 18*v*, 18*w*, and transmits this generated motor rotation signal to the control circuit 150.

Concretely, the rotation signal generating section 120 has a first XOR gate 121, a second XOR gate 122 and an inverter gate 123. The detecting signal of each of the Hall effect elements 18*v*, 18*w* is inputted to the first XOR gate 121. The detecting signal of the Hall element 18*u* and an output signal of the first XOR gate 121 are inputted to the second XOR gate 122. An output signal of the second XOR gate 122 is inputted to the inverter gate 123. As shown in FIG. 5, the voltage of the output signal of the inverter gate 123 is switched between a high (H) level and a low (L) level every time an edge appears in one of the detecting signals of the respective Hall effect elements 18*u*, 18*v*, 18*w*. Here, while the voltage of the output signal of the inverter gate 123 is held, the rotating angle range of the motor shaft 14 becomes an angular range $X_\theta$ approximately conforming to ⅓ of the above $W_\theta$. Therefore, the rotation signal generating section 120 of this embodiment calculates the absolute value of the real rotation speed $R_m$ of the motor shaft 14 from the time difference between edges appearing in the output signal of the inverter gate 123. The rotation signal generating section 120 of this embodiment simultaneously calculates the rotating direction of the motor shaft 14, i.e., the sign of the real rotation speed $R_m$ from the appearing order of the edges in the detecting signals of the respective Hall effect elements 18*u*, 18*v*, 18*w*. The motor rotation signal is generated so as to show the real rotation speed $R_m$ of the motor shaft 14 thus calculated with respect to the absolute value and the sign, and is transmitted to the control circuit 150.

Figure 1:
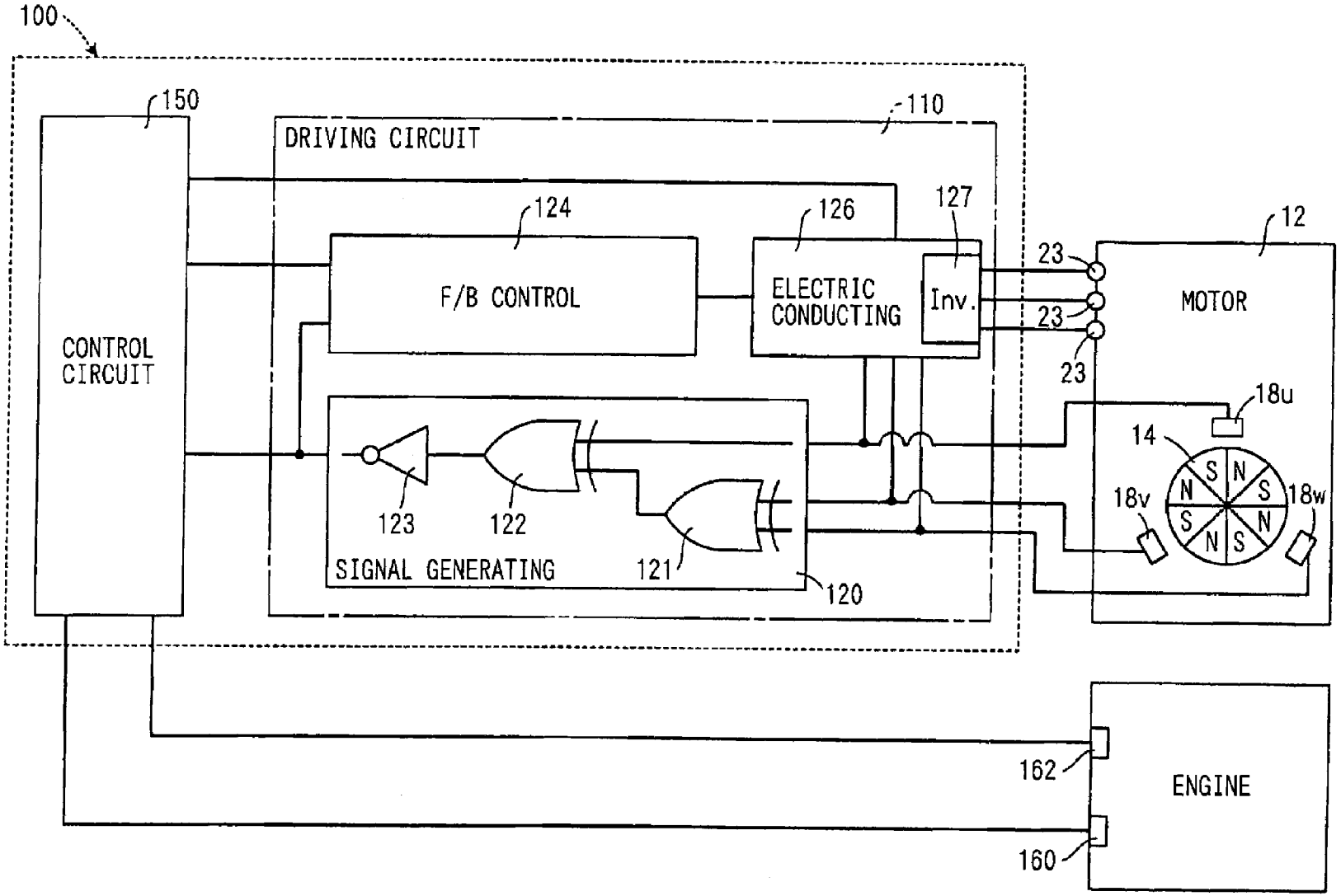
FIG. 1 is a block diagram showing a motor controller in accordance with a first embodiment.

As shown in FIG. 1, the feedback control section 124 is connected to the rotation signal generating section 120, and receives the motor rotation signal generated by the rotation signal generating section 120. The feedback control section 124 is connected to the control circuit 150, and receives the first control signal generated by the control circuit 150. The feedback control section 124 generates a command signal for giving the command of an application voltage $V_m$ applied to the motor 12 to the electric conducting section 126 on the basis of the received motor rotation signal and the first control signal. Concretely, the feedback control section 124 determines the application voltage $V_m$ as a control value for conforming the absolute value of the real rotation speed $R_m$ shown by the motor rotation signal to the target rotation speed $r_m$ shown by the first control signal. The feedback control section 124 then generates the command signal so as to show the determined application voltage $V_m$.

The electric conducting section 126 is connected to the feedback control section 124, and receives the command signal generated by the feedback control section 124. The electric conducting section 126 is also connected to the control circuit 150, and receives the second control signal generated by the control circuit 150. Furthermore, the electric conducting section 126 is connected to a terminal 23 of the motor 12, and applies the voltage $V_m$ shown by the command signal to the motor 12 so as to realize the target rotating direction $d_m$ shown by the second control signal. Concretely, the electric conducting section 126 connected to the Hall effect elements 18*u*, 18*v*, 18*w* and having an inverter circuit 127 as shown in FIG. 6 determines a switching pattern of each switching element 128 of the inverter circuit 127 on the basis of the detecting signal of each of the Hall effect elements 18*u*, 18*v*, 18*w*, the second control signal and the command signal. The electric conducting section 126 then applies the voltage to the winding 22 between two switching elements 128 turned on by switching the turning-on and turning-off of each switching element 128 in accordance with the determined switching pattern.

In accordance with the motor controller 100 explained above, when the real rotation speed $R_{ca}$ of the camshaft 11 becomes a low rotation speed less than the reference value $R_{cas}$, the control circuit 150 generates the first and second control signals on the basis of the motor rotation signal showing the real rotation speed $R_m$ of the motor shaft 14. Here, since the reference value $R_{cas}$ is the detecting lower limit value of the first rotation speed sensor 160 or more, the generation of the first and second control signals based on the motor rotation signal and the electric conducting operation of the motor 12 according to the first and second control signals are realized even when the real rotation speed $R_{ca}$ of the camshaft 11 is smaller than the detecting lower limit value of the first rotation speed sensor 160. Further, since the reference value $R_{cas}$ is also the detecting lower limit value of the second rotation speed sensor 162 or more, the generation of the first and second control signals based on the motor rotation signal and the electric conducting operation of the motor 12 according to the first and second control signals are realized even when the real rotation speed $R_{cr}$ of the crankshaft is smaller than the detecting lower limit value of the second rotation speed sensor 162.

Further, in accordance with the motor controller 100, when the real rotation speed $R_{ca}$ of the camshaft 11 becomes a high rotation speed of the reference value $R_{cas}$ or more, the control circuit 150 generates the first and second control signals on the basis of the first engine speed signal showing the real rotation speed $R_{ca}$ of the camshaft 11 and the second engine speed signal showing the real rotation speed $R_{cr}$ of the crankshaft. Here, the reference value $R_{cas}$ is the detecting lower limit values of the first and second rotation speed sensors 160, 162 or more, and the real rotation speed $R_{ca}$ of the camshaft 11 is about half the real rotation speed $R_{cr}$ of the crankshaft. Therefore, when the real rotation speed $R_{ca}$ of the camshaft 11 becomes the reference value $R_{cas}$ or more, both the first and second engine speed signals are outputted. Accordingly, the generation of the first and second control signals based on the first and second engine speed signals and the electric conducting operation of the motor 12 according to the first and second control signals are reliably realized.

The valve timing can be appropriately adjusted in accordance with the height of the engine rotation in the valve timing controller 10 in which the motor 12 is driven and controlled by such a motor controller 100.

The control circuit 150 of the motor controller 100 utilizes the first and second engine speed signals in the control of the engine. Therefore, when the control signal is generated on the basis of the motor rotation signal, a large load is applied to the control circuit 150 in comparison with a case in which the control signal is generated on the basis of the first and second engine speed signals. However, the generation of the first and second control signals based on the motor rotation signal is limited to the case in which the real rotation speed $R_{ca}$ of the camshaft 11 is less than the reference value $R_{cas}$. Accordingly, the valve timing can be appropriately adjusted while an increase in the load in the control circuit 150 is restrained as much as possible.

Second Embodiment

Figure 8:
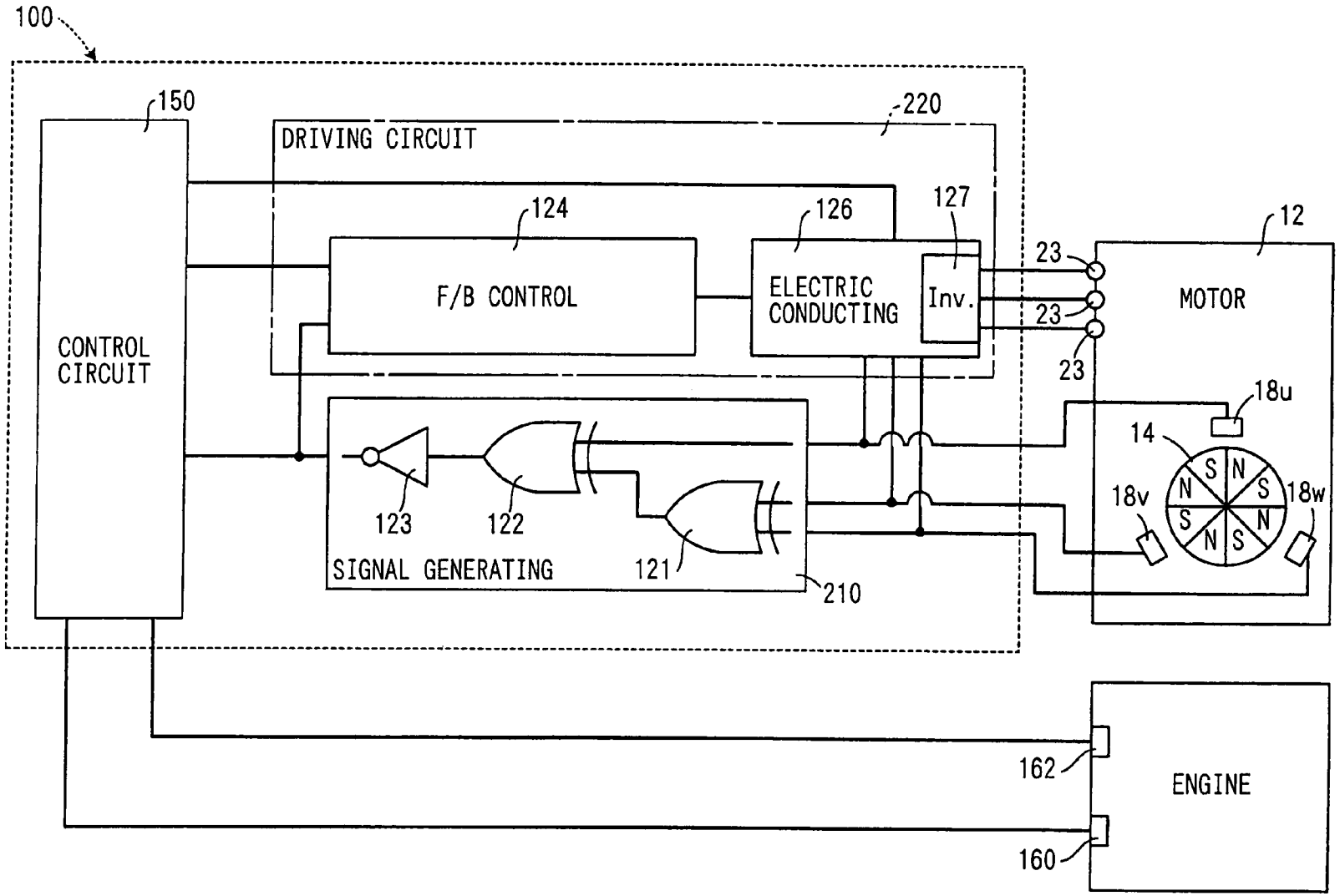
FIG. 8 is a block diagram showing a motor controller in accordance with a second embodiment.

As shown in FIG. 8, a second embodiment of the present invention is a modified example of the first embodiment. The substantial same constructional portions as the first embodiment are designated by the same reference numerals, and their explanations are omitted.

A motor controller 200 of the second embodiment has a rotation signal generating circuit 210 corresponding to the rotation signal generating section 120 of the first embodiment as a circuit different from a driving circuit 220. In the motor controller 200 of such a second embodiment, effects similar to those in the case of the motor controller 100 of the first embodiment are also obtained.

Third Embodiment

Figure 9:
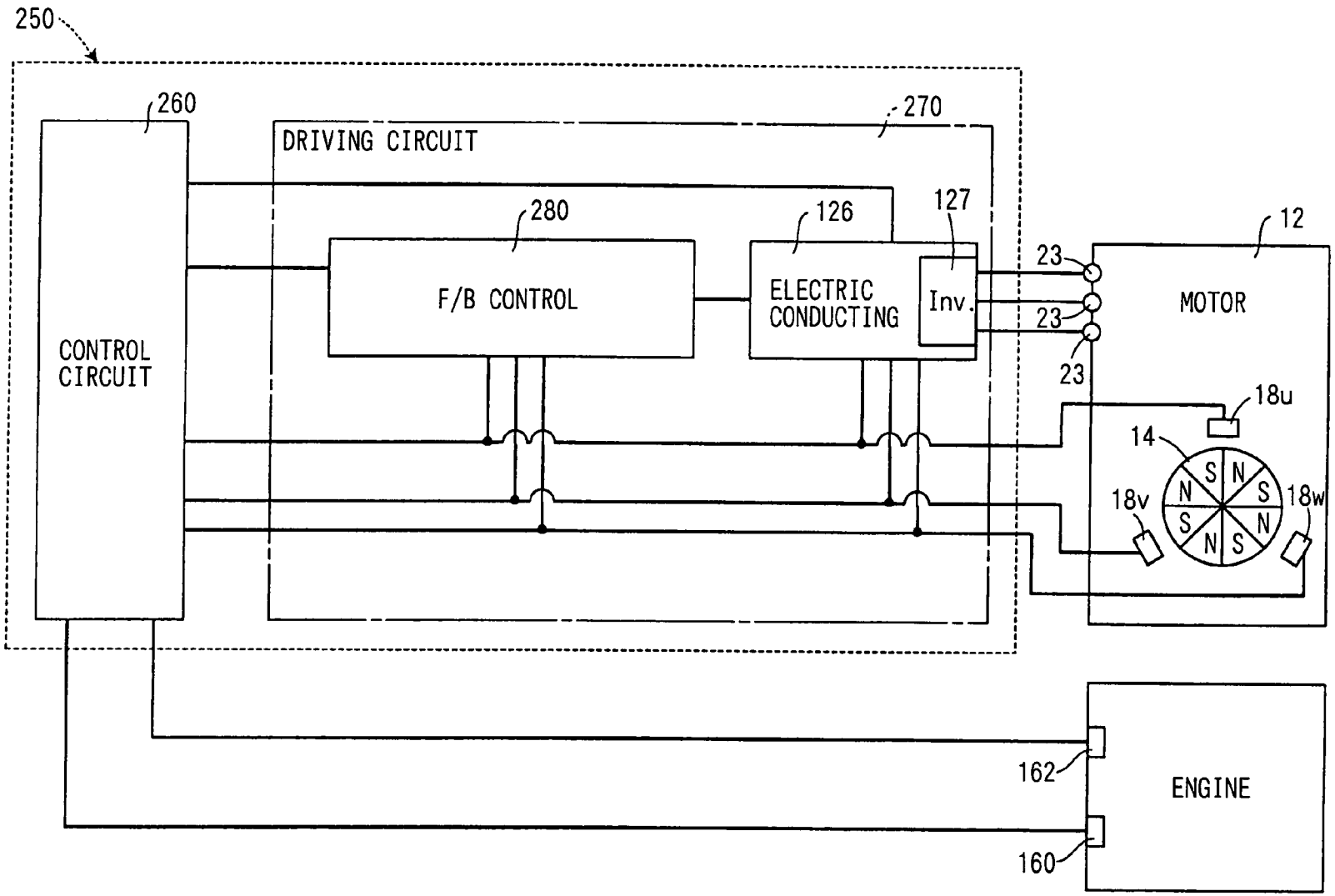
FIG. 9 is a block diagram showing a motor controller in accordance with a third embodiment.

As shown in FIG. 9, a third embodiment of the present invention is a modified example of the first embodiment, and the substantial same constructional portions as the first embodiment are designated by the same reference numerals and their explanations are omitted.

In a motor controller 250 of the third embodiment, a control circuit 260 is connected to Hall effect elements 18*u*, 18*v*, 18*w* through a driving circuit 270. The control circuit 260 receives a detecting signal generated by each of the Hall effect elements 18*u*, 18*v*, 18*w* as a motor rotation signal showing the real rotating position θ of the motor shaft 14. The control circuit 260 calculates the absolute value of the real rotation speed $R_m$ of the motor shaft 14 by realizing a function similar to that of each of gates 121, 122, 123 of the rotation signal generating section 120 of the first embodiment, and also calculates the sign of the real rotation speed $R_m$ similarly to the rotation signal generating section 120 of the first embodiment. Thus, the absolute value and the sign are calculated and the control circuit 260 can generate first and second control signals similarly to the first embodiment by utilizing the real rotation speed $R_m$ of the motor shaft 14.

In the driving circuit 270 of the motor controller 250, no rotation signal generating section 120 of the first embodiment is arranged and the Hall effect elements 18*u*, 18*v*, 18*w* are connected to a feedback control section 280. The feedback control section 280 calculates the absolute value of the real rotation speed $R_m$ of the motor shaft 14 from the time difference between edges appearing in at least one of the motor rotation signals received from the respective Hall effect elements 18*u*, 18*v*, 18*w*. The feedback control section 280 then determines an application voltage $V_m$ as a control value for conforming the calculated absolute value of the real rotation speed $R_m$ to a target rotation speed $r_m$ shown by the first control signal, and generates a command signal showing this application voltage $V_m$.

Thus, in the motor controller 250 of the third embodiment, effects similar to those in the case of the motor controller 100 of the first embodiment can be also obtained.

Figure 10:
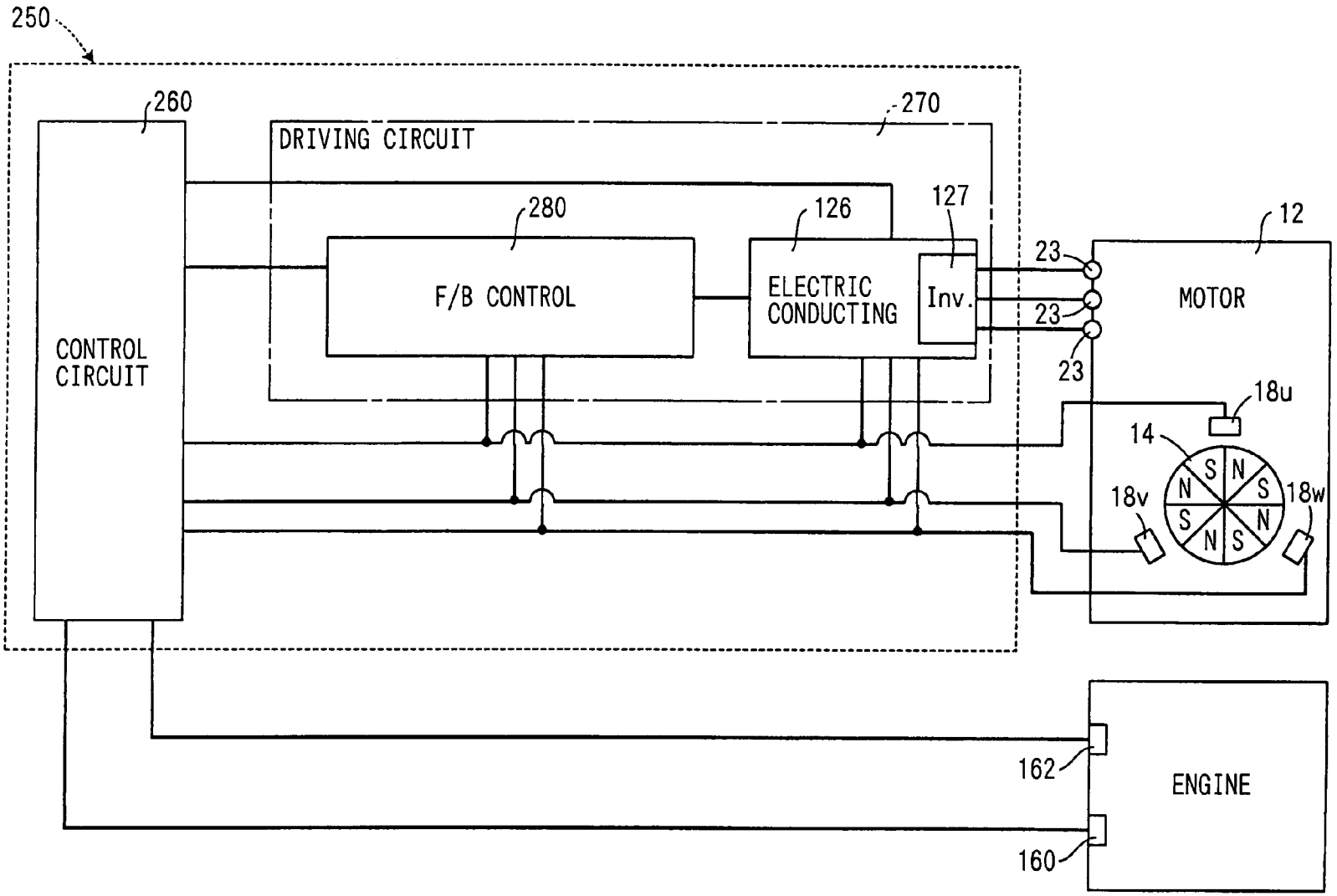
FIG. 10 is a block diagram showing a motor controller in a modified example of the third embodiment.

As shown in the modified example of the third embodiment in FIG. 10, the detecting signal of each of the Hall effect elements 18*u*, 18*v*, 18*w* may be also transmitted to the control circuit 260 without interposing the driving circuit 270.

Fourth Embodiment

Figure 11:
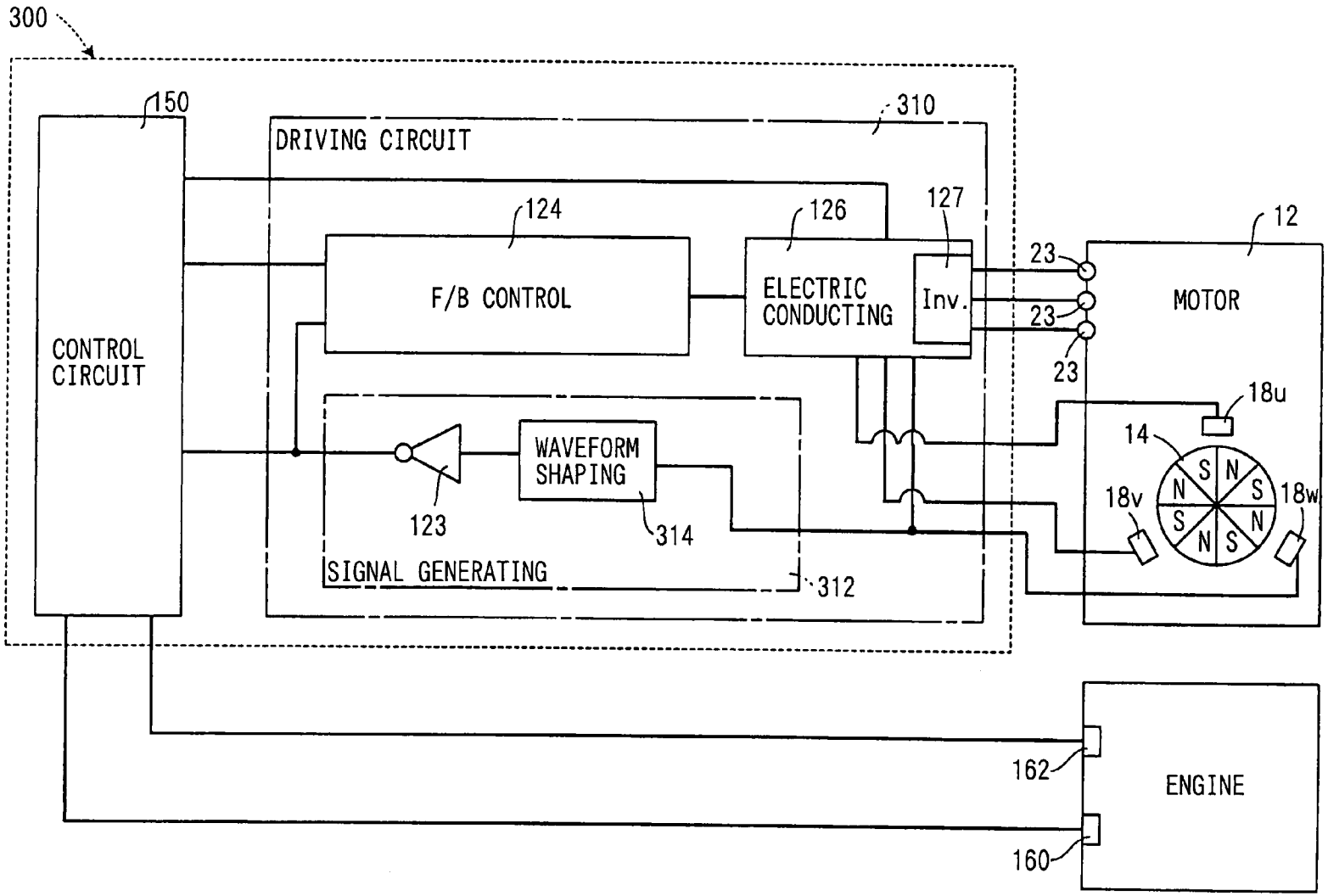
FIG. 11 is a block diagram showing a motor controller in accordance with a fourth embodiment.

As shown in FIG. 11, a fourth embodiment of the present invention is a modified example of the first embodiment, and the substantial same constructional portions as the first embodiment are designated by the same reference numerals, and their explanations are omitted.

A waveform shaping section 314 is arranged on the input side of an inverter gate 123 in a rotation signal generating section 312 of a driving circuit 310 in a motor controller 300 of the fourth embodiment. This waveform shaping section 314 is connected to only one Hall element 18*w* among the Hall effect elements 18*u*, 18*v*, 18*w*, and performs shaping processing for sharpening an edge with respect to the detecting signal of this Hall element 18*w*, and outputs this processed detecting signal to the inverter gate 123. Thus, a control circuit 150 receives a motor rotation signal provided by substantially inverting the detecting signal of the Hall element 18*w*, and can calculate the absolute value of the real rotation speed $R_m$ of the motor shaft 14 from the time difference between edges in this motor rotation signal. Accordingly, in the motor controller 300 of the fourth embodiment, effects similar to those in the case of the motor controller 100 of the first embodiment are also obtained.

In the fourth embodiment, the detecting signal of the Hall element 18*w* shaped by the waveform shaping section 314 may be also transmitted to the control circuit 150 without inverting this detecting signal.

Fifth Embodiment

Figure 12:
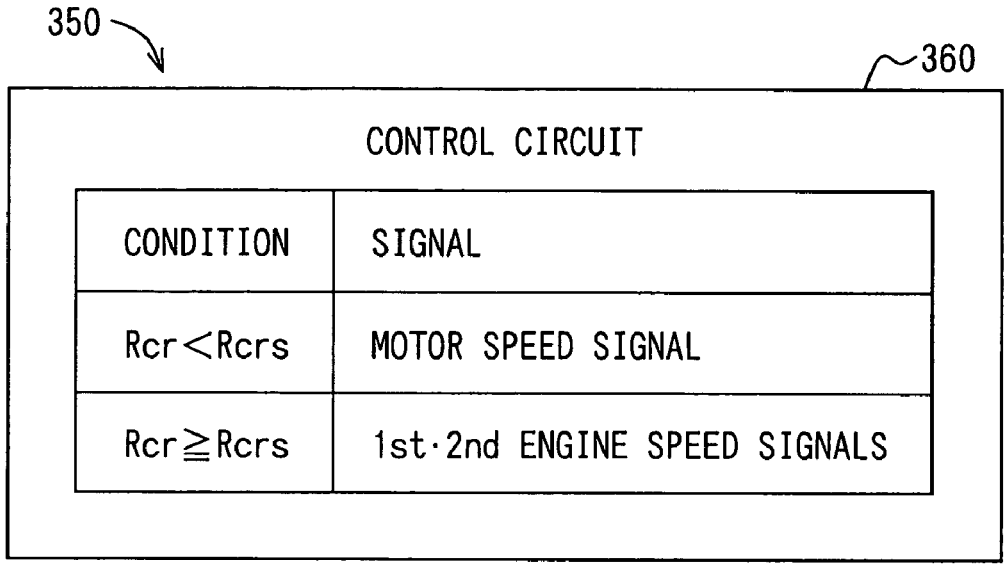
FIG. 12 is a typical view for explaining the operation of a motor controller in accordance with a fifth embodiment.

As shown in FIG. 12, a fifth embodiment of the present invention is a modified example of the first embodiment, and the substantial same constructional portions as the first embodiment are designated by the same reference numerals, and their explanations are omitted.

In a motor controller 350 of the fifth embodiment, a control circuit 360 switches the generating system of a control signal in accordance with the large and small relation of a predetermined reference value $R_{crs}$ and the real rotation speed $R_{cr}$ of the crankshaft shown by a second engine speed signal received from a second rotation speed sensor 162. Here, the reference value $R_{crs}$ is set to a value equal to or greater than detecting lower limit values of the first and second rotation speed sensors 160, 162, and is stored to a memory of the control circuit 360 in advance.

More concretely, when the real rotation speed $R_{cr}$ of the crankshaft shown by the second engine speed signal is less than the reference value $R_{crs}$, the control circuit 360 generates first and second control signals on the basis of a motor rotation signal received from a driving circuit 110 as shown in FIG. 12. The generating method of each control signal at this time is similar to the generating method when the real rotation speed $R_{ca}$ is less than the reference value $R_{cas}$ in the first embodiment. Accordingly, even when the respective real rotation speeds $R_{cr}$, $R_{ca}$ of the crankshaft and the camshaft 11 are lower than the corresponding detecting lower limit values of the sensors 160, 162, the generation of the first and second control signals using the control circuit 360, in its turn, the electric conducting operation of the motor 12 using the driving circuit 110 can be reliably embodied.

In contrast to this, when the real rotation speed $R_{cr}$ of the crankshaft shown by the second engine speed signal becomes the reference value $R_{crs}$ or more, the control circuit 360 generates the first and second control signals on the basis of the first and second engine speed signals received from the first and second rotation speed sensors 160, 162 as shown in FIG. 12. The generating method of each control signal at this time is similar to the generating method when the real rotation speed $R_{ca}$ becomes the reference value $R_{cas}$ or more in the first embodiment. Accordingly, since the control circuit 360 can embody the generation of the control signals by utilizing the engine speed signals reliably outputted from the respective sensors 160, 162, the electric conducting operation of the motor 12 using the driving circuit 110 can be reliably executed.

Sixth Embodiment

Figure 13:
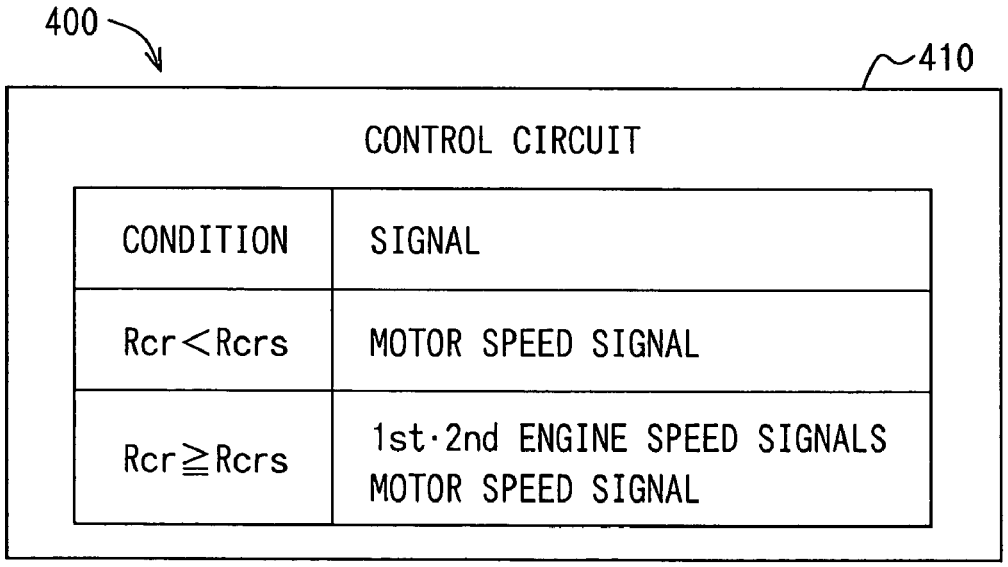
FIG. 13 is a typical view for explaining the operation of a motor controller in accordance with a sixth embodiment.

As shown in FIG. 13, a sixth embodiment of the present invention is a modified example of the fifth embodiment, and the substantial same constructional portions as the fifth embodiment are designated by the same reference numerals, and their explanations are omitted.

As shown in FIG. 13, when the real rotation speed $R_{cr}$ of the crankshaft is the reference value $R_{crs}$ or more, a control circuit 410 in a motor controller 400 of the sixth embodiment generates each control signal on the basis of an engine speed signal received from each of the sensors 160, 162 and a motor rotation signal received from the driving circuit 110. Concretely, the control circuit 410 detects reference valve timing from the real rotation speed $R_{ca}$ of the camshaft 11 shown by a first engine speed signal and the real rotation speed $R_{cr}$ of the crankshaft shown by a second engine speed signal every one rotation of the engine. Further, the control circuit 410 detects a phase difference with respect to this reference valve timing from the real rotation speed $R_m$ of the motor shaft 14 shown by the motor rotation signal, and calculates the real valve timing from this phase difference and the reference valve timing. The control circuit 410 then determines the target rotation speed $r_m$ and the target rotating direction $d_m$ from the phase difference between this real valve timing and target valve timing separately set, and generates the first and second control signals so as to respectively show the target rotation speed $r_m$ and the target rotating direction $d_m$. When the real rotation speed $R_{cr}$ of the crankshaft is less than the reference value $R_{crs}$, the control circuit 410 generates the first and second control signals similarly to the fifth embodiment (first embodiment).

Thus, the control circuit 410 can accurately obtain the target rotation speed $r_m$ by utilizing the motor rotation signal as well as the engine speed signal when the real rotation speed $R_{cr}$ of the crankshaft becomes a high rotation speed equal to or greater than the reference value $R_{crs}$. Accordingly, since the driving circuit 110 can turn on and drive the motor 12 in accordance with the first control signal showing the accurate target rotation speed $r_m$, adjustment accuracy of the valve timing is improved.

Seventh Embodiment

Figure 14:
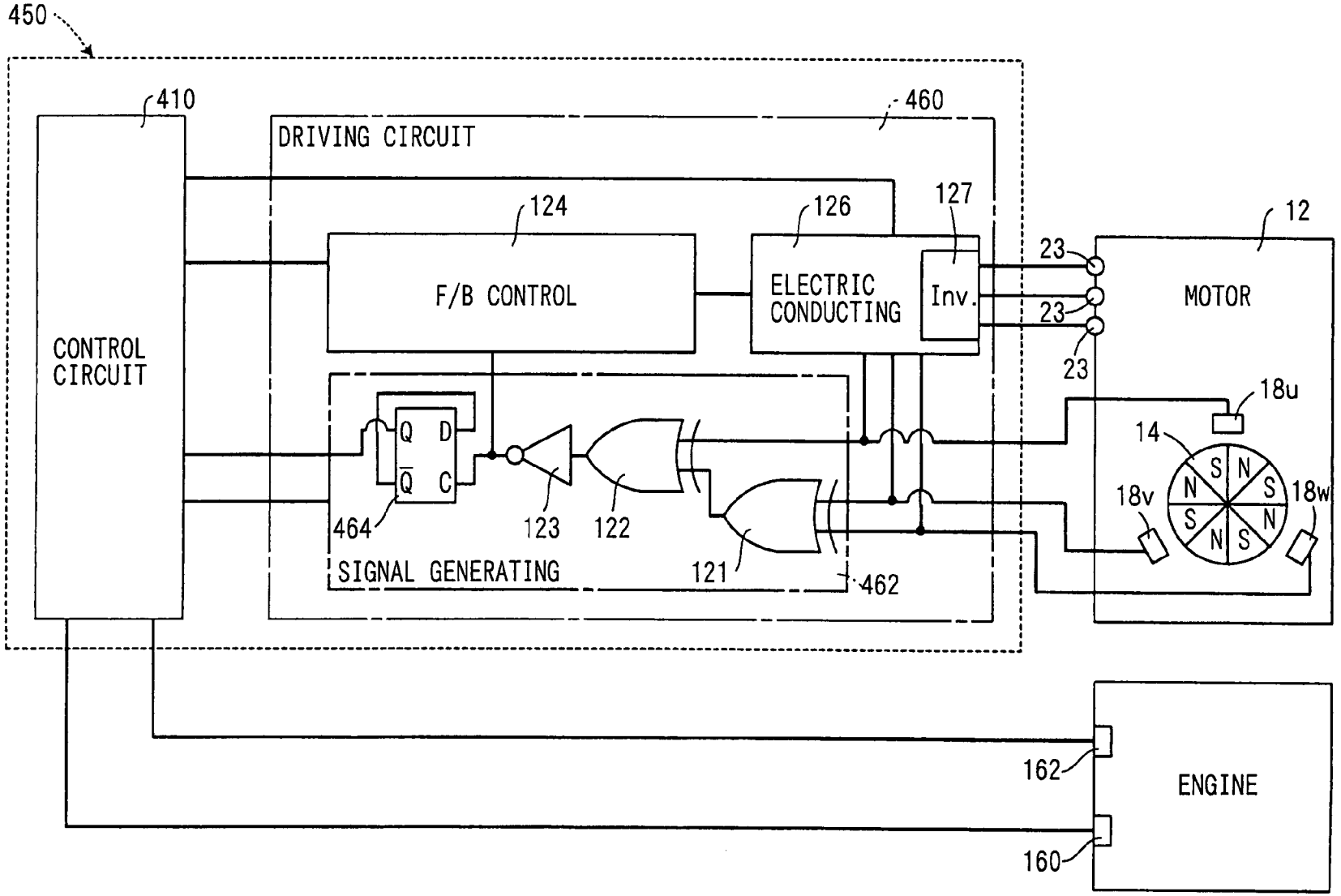
FIG. 14 is a block diagram showing a motor controller in accordance with a seventh embodiment.

As shown in FIG. 14, a seventh embodiment of the present invention is a modified example of the sixth embodiment, and the substantial same constructional portions as the sixth embodiment are designated by the same reference numerals, and their explanations are omitted.

In a motor controller 450 of the seventh embodiment, a D-type flip flop (hereinafter called D-FF) 464 of one stage is arranged on the output side of an inverter gate 123 in a rotation signal generating section 462 of a driving circuit 460. This D-FF 464 raises and lowers the levels of output signals from a data output terminal and an inverted data output terminal in response to a rising edge of an input signal to a clock input terminal.

Figure 15:
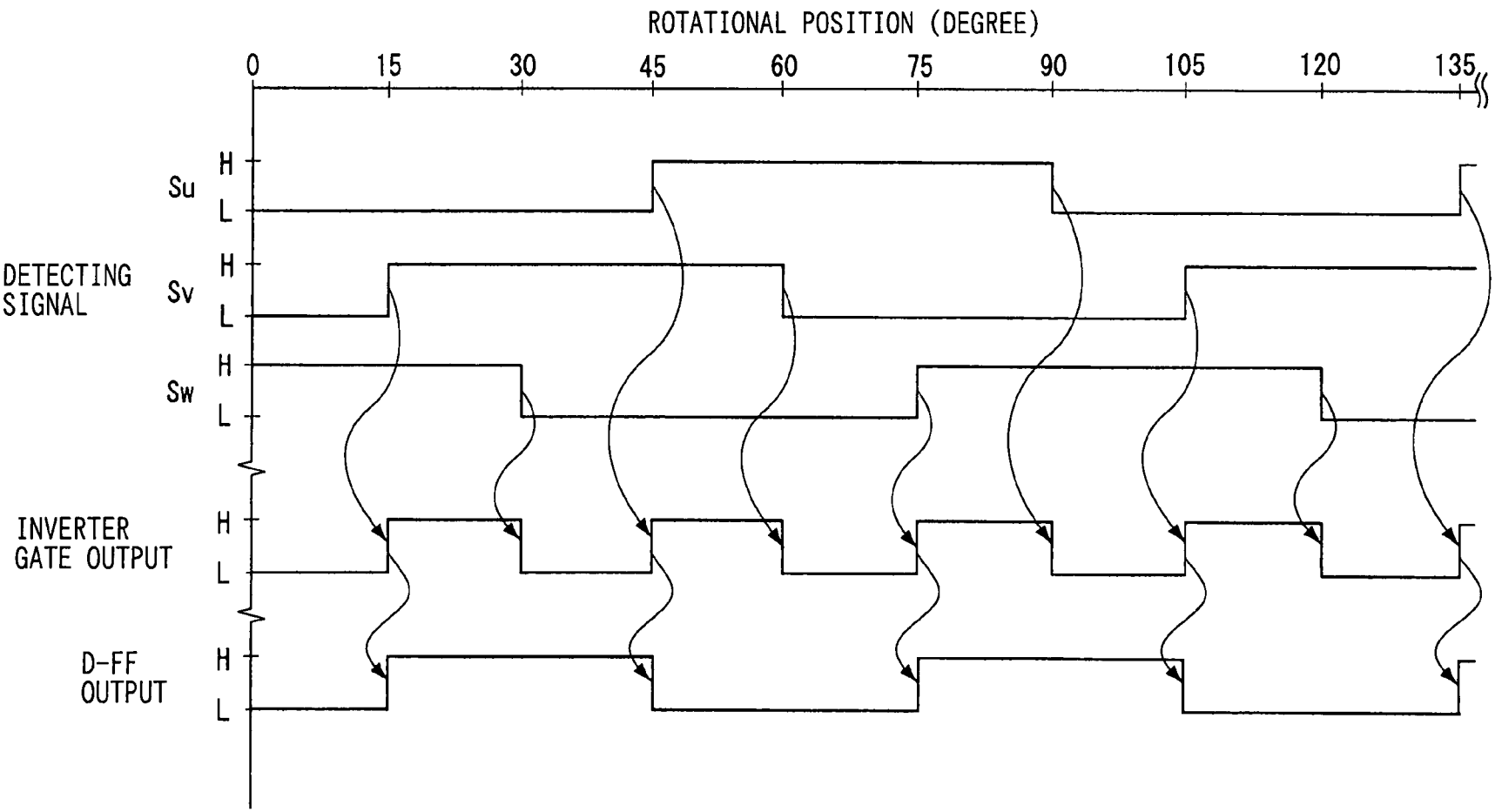
FIG. 15 is a typical view for explaining the operation of the motor controller in accordance with the seventh embodiment.

Concretely, the output signal of the inverter gate 123 is inputted to the clock input terminal of the D-FF 464 as a motor rotation signal, and the output signal of the inverted signal output terminal of this D-FF 464 is inputted to a signal input terminal of the D-FF 464. Accordingly, as shown in FIG. 15, the motor rotation signal outputted from the signal output terminal of the D-FF 464 becomes a signal having a half number of edges in comparison with an output time point from the inverter gate 123. Here, the time difference between continuous edges in the motor rotation signal outputted from the D-FF 464 becomes equal to the time difference between two continuous rising edges with one falling edge between in the output signal from the inverter gate 123. Namely, the motor rotation signal outputted from the D-FF 464 becomes a signal accurately reflecting the absolute value of the real rotation speed $R_m$ of the motor shaft 14. Accordingly, the motor rotation signal is transmitted to the control circuit 410 as a signal showing the absolute value of the real rotation speed $R_m$. In this embodiment, the sign of the real rotation speed $R_m$ of the motor shaft 14 calculated from the detecting signal of each of the Hall effect elements 18*u*, 18*v*, 18*w* is propagated from the rotation signal generating section 462 to the control circuit 410 by a motor direction signal different from the motor rotation signal. Therefore, the control circuit 410 can grasp the real rotation speed $R_m$ with the sign on the basis of the motor rotation signal and the motor direction signal.

Thus, with respect to the motor rotation signal outputted from the D-FF 464 to the control circuit 410, the rotation signal generating section 462 can reduce the number of edges to half without causing an error in the real rotation speed $R_m$ as its propagation information. Therefore, at a high speed rotation time of the motor 12, the time difference between edges of the motor rotation signal can be doubly increased at a signal transmitting time point to the control circuit 410 even when there is no sufficient time difference between the edges of the motor rotation signal at the output time point from the inverter gate 123. Thus, since the processing amount of the motor rotation signal can be restrained to a small amount in the control circuit 410, the load in this control circuit 410 can be reduced.

Figure 16:
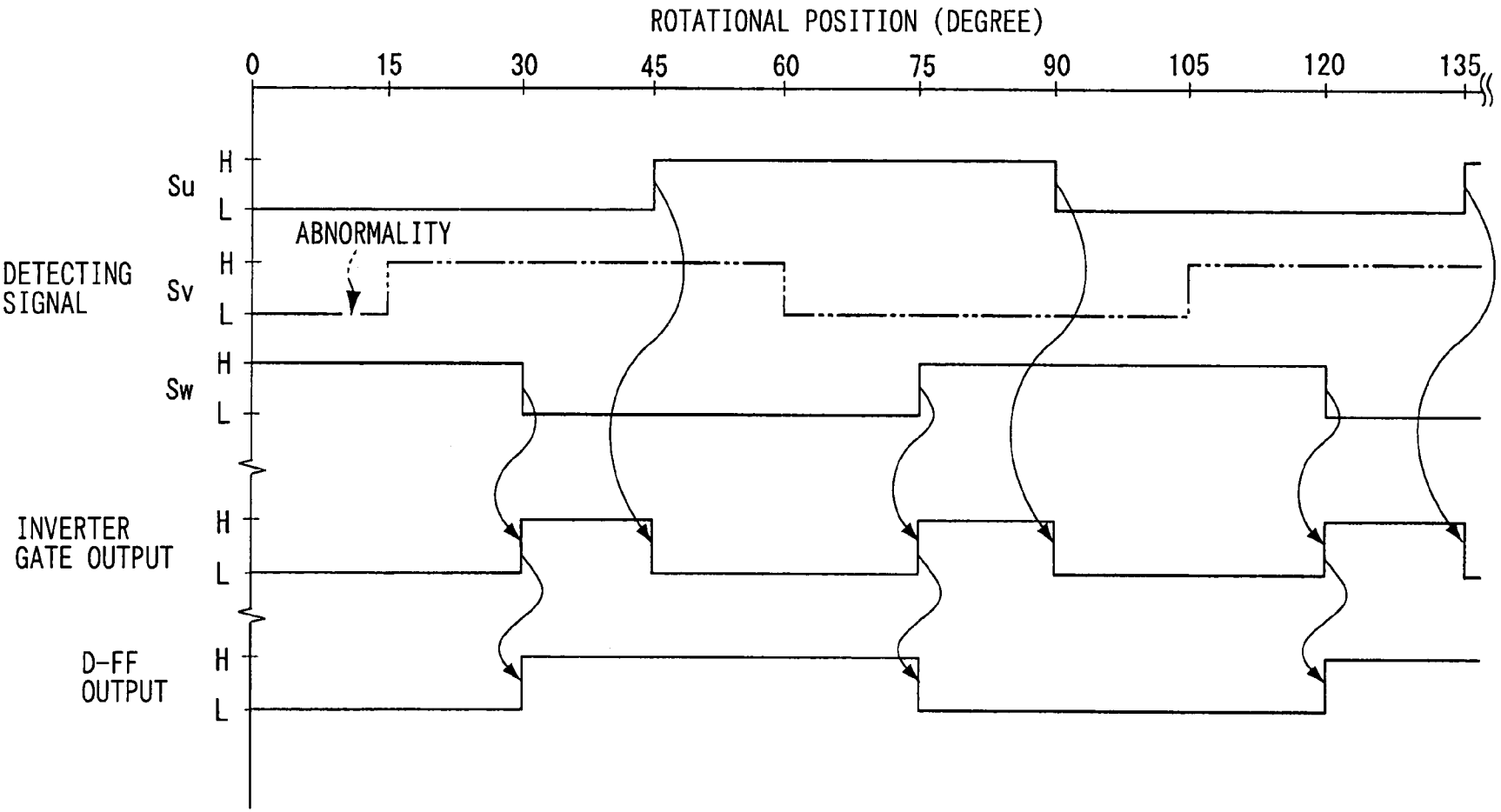
FIG. 16 is a typical view for explaining the operation of the motor controller in accordance with the seventh embodiment.

Further, when an abnormality is generated in the signal transmission from at least one of the Hall effect elements 18*u*, 18*v*, 18*w* to the rotation signal generating section 462, for example, as shown in FIG. 16, no voltage switching corresponding to an edge of this abnormality signal (shown by a two-dotted chain line) appears in the output signal from the inverter gate 123. Therefore, at this time, an edge appears at different timings from the normal timing (see FIG. 15) in the motor rotation signal outputted from the D-FF 464. Accordingly, in the control circuit 410 receiving the motor rotation signal from the D-FF 464, it is possible to judge the abnormality of the Hall effect elements 18*u*, 18*v*, 18*w* from the appearance timing of the edge of this receiving signal. In the judgment of the abnormality, for example, it adopts a method, etc. in which the time difference between the edge and an edge located before by one is calculated every appearance of the edge in the motor rotation signal, and the ratio of this calculated time difference and the time difference calculated at the previous edge appearing time is collated with the normal ratio.

Eighth Embodiment

Figure 17:
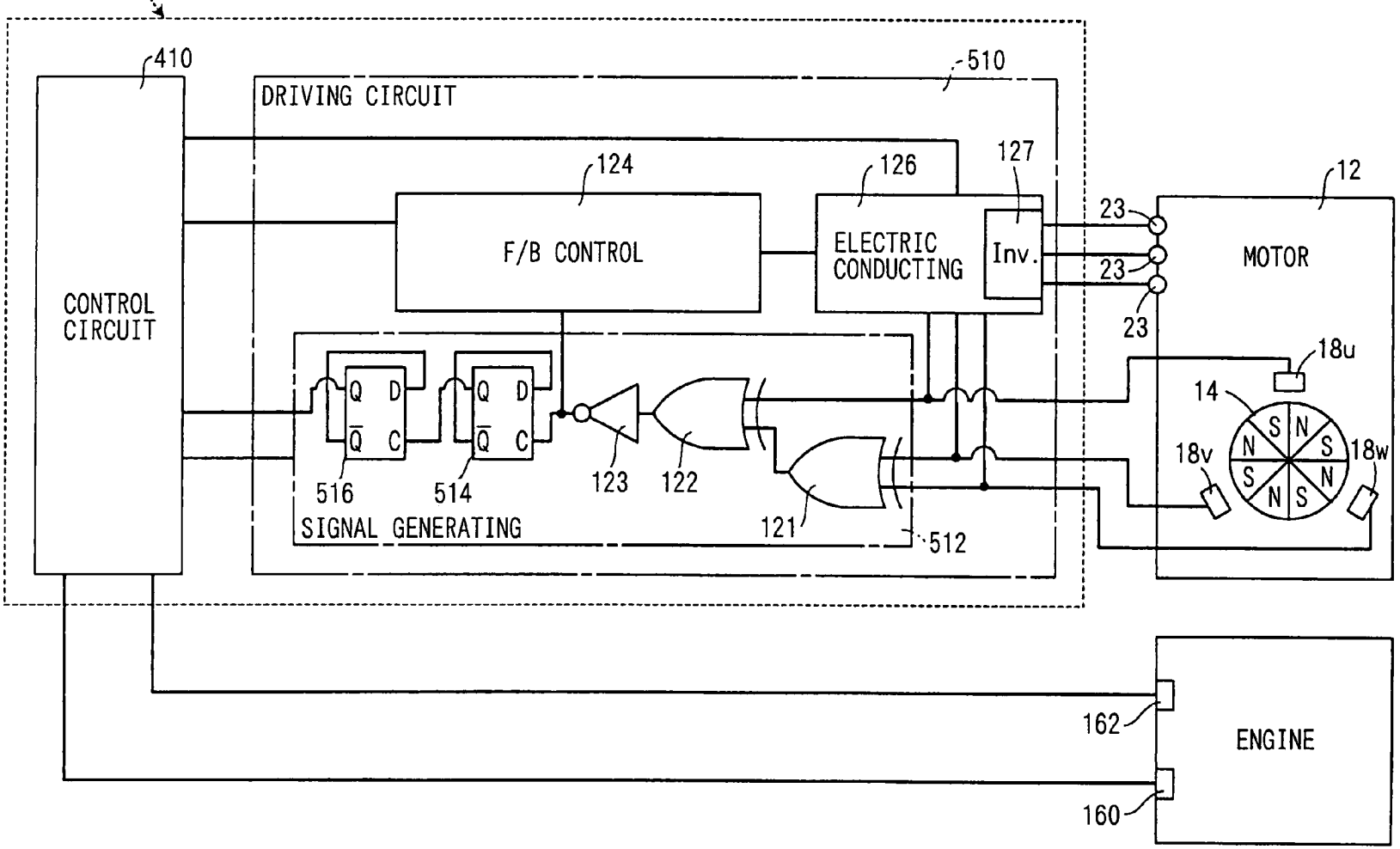
FIG. 17 is a block diagram showing a motor controller in accordance with an eighth embodiment.

As shown in FIG. 17, an eighth embodiment of the present invention is a modified example of the seventh embodiment, and the substantial same constructional portions as the seventh embodiment are designated by the same reference numerals, and their explanations are omitted.

In a motor controller 500 of the eighth embodiment, D-type flip flops 514, 516 of two stages are arranged on the output side of an inverter gate 123 in a rotation signal generating section 512 of a driving circuit 510. Both these D-FFs 514 and 516 raise and lower the levels of output signals from a data output terminal and an inverted data output terminal in response to a rising edge of an input signal to a clock input terminal.

Figure 18:
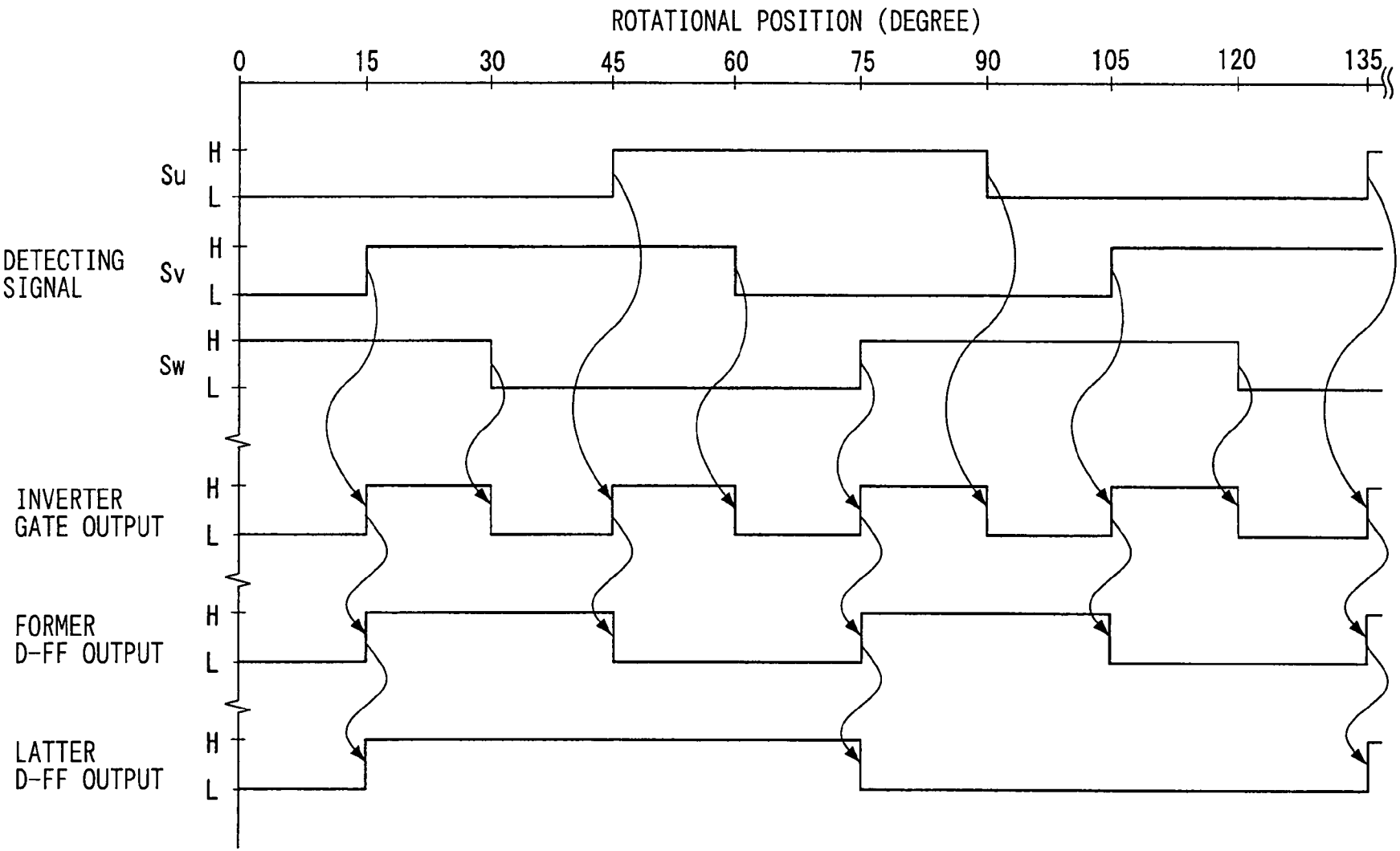
FIG. 18 is a typical view for explaining the operation of the motor controller in accordance with the eighth embodiment.

Concretely, the former stage D-FF 514 is set to a signal input mode similar to that of the D-FF 464 of the seventh embodiment. Further, with respect to the latter stage D-FF 516, the output signal of the signal output terminal of the former stage D-FF 514 is inputted to the clock input terminal, and the output signal of the inverted signal output terminal of this D-FF 516 is inputted to a signal input terminal. Accordingly, as shown in FIG. 18, the motor rotation signal outputted from the signal output terminal of the latter stage D-FF 516 becomes a signal of ¼ in the number of edges in comparison with an output time point from the inverter gate 123. Here, the time difference between continuous edges in the motor rotation signal outputted from the latter stage D-FF 516 becomes equal to the time difference between rising edges separated by two periods from each other in the output signal from the inverter gate 123. Namely, the motor rotation signal outputted from the latter stage D-FF 516 accurately reflects the absolute value of the real rotation speed $R_m$ of the motor shaft 14. Accordingly, the motor rotation signal is transmitted to the control circuit 410 as a signal showing the absolute value of this real rotation speed $R_m$.

Thus, with respect to the motor rotation signal outputted from the latter stage D-FF 512 to the control circuit 410, the rotation signal generating section 512 can reduce the number of edges to ¼ without causing an error in the real rotation speed $R_m$ as its propagation information. Therefore, the load in the control circuit 410 is reduced by a principle similar to that of the seventh embodiment.

Ninth Embodiment

Figure 19:
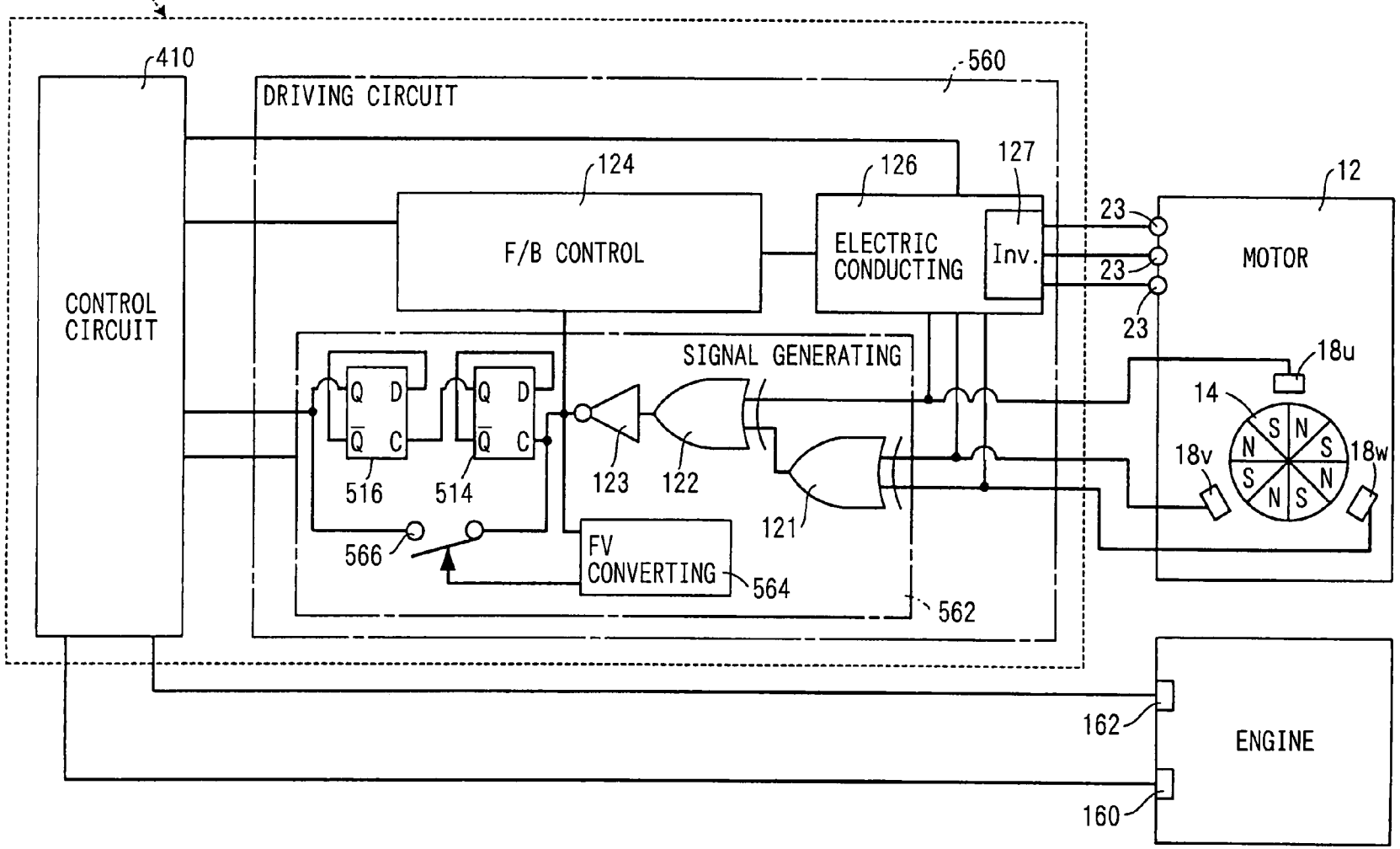
FIG. 19 is a block diagram showing a motor controller in accordance with a ninth embodiment.

As shown in FIG. 19, a ninth embodiment of the present invention is a modified example of the eighth embodiment, and the substantial same constructional portions as the eighth embodiment are designated by the same reference numerals and their explanations are omitted.

Figure 20:
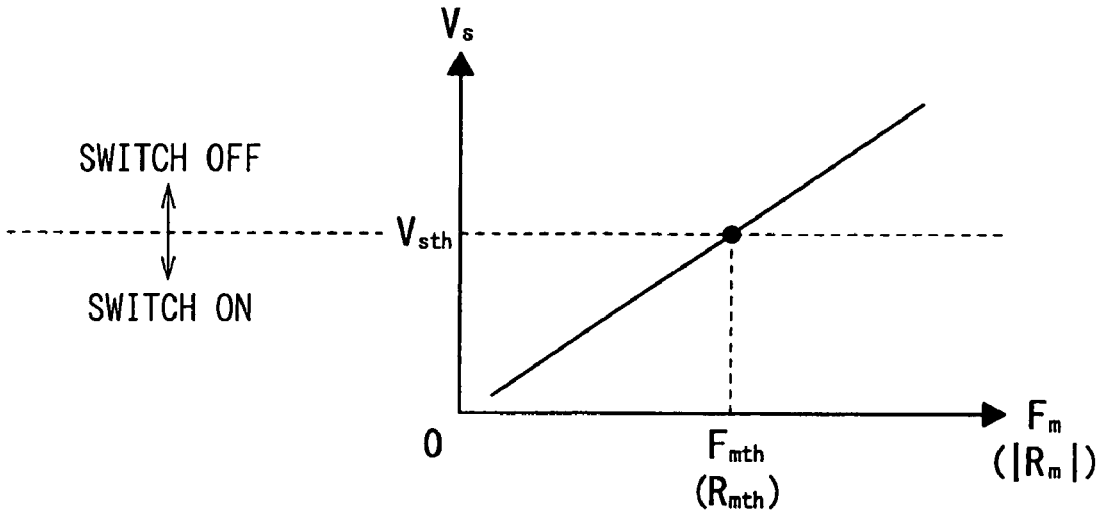
FIG. 20 is a characteristic view for explaining the operation of the motor controller in accordance with the ninth embodiment.

In a motor controller 550 of the ninth embodiment, an FV converting section 564 is arranged on the output side of an inverter gate 123 in a rotation signal generating section 562 of a driving circuit 560. This FV converting section 564 calculates a signal frequency $F_m$ from the time difference between two continuous rising edges with one falling edge between (i.e., calculates an inverse number of this time difference) with respect to an output signal of the inverter gate 123. Further, the FV converting section 564 linearly converts the calculated signal frequency $F_m$ into a switch voltage $V_s$ as shown in FIG. 20. Thus, when the signal frequency $F_m$ is less than a threshold value $F_{mth}$, the switch voltage $V_s$ is less than a threshold value $V_{sth}$. In contrast to this, when the signal frequency $F_m$ is the threshold value $F_{mth}$ or more, the switch voltage $V_s$ becomes the threshold value $V_{sth}$ or more. In this embodiment, the signal frequency $F_m$ becomes a value proportional to the absolute value of the real rotation speed $R_m$ of the motor shaft 14. Accordingly, in this embodiment, as shown in FIG. 20, when the absolute value of the real rotation speed $R_m$ is less than a corresponding value $R_{mth}$ of the threshold value $F_{mth}$, it can be considered that the switch voltage $V_s$ is less than the threshold value $V_{sth}$. In contrast to this, when the absolute value of the real rotation speed $R_m$ becomes the corresponding value $R_{mth}$ or more of the threshold value $F_{mth}$, it can be considered that the switch voltage $V_s$ becomes the threshold value $V_{sth}$ or more.

Further, a switch section 566 is arranged between the inverter gate 123 and the control circuit 410 in the rotation signal generating section 562. This switch section 566 switches the propagating path of the motor rotation signal from the inverter gate 123 to the control circuit 410 in accordance with the switch voltage $V_s$ inputted from the FV converting section 564. Concretely, when the switch voltage $V_s$ is less than the threshold value $V_{sth}$, the switch section 566 directly propagates the motor rotation signal from the inverter gate 123 to the control circuit 410 by transferring this switch section 566 to a turning-on state as shown in FIG. 20. Accordingly, at this time, the control circuit 410 receives the motor rotation signal generated by gates 121 to 123 as it is. In contrast to this, when the switch voltage $V_s$ becomes the threshold voltage $V_{sth}$ or more, the switch section 566 propagates the motor rotation signal from the inverter gate 123 to the control circuit 410 via the D-FFs 514, 516 by transferring the switch section 566 to a turning-off state as shown in FIG. 20. Accordingly, at this time, the control circuit 410 receives the motor rotation signal in which the number of edges is reduced to ¼ in comparison with an output time point from the inverter gate 123.

In accordance with such a rotation signal generating section 562, when the absolute value of the real rotation speed $R_m$ of the motor shaft 14 is less than the value $R_{mth}$, the motor rotation signal generated by gates 121 to 123 is transmitted to the control circuit 410 as it is. Accordingly, the real rotation speed $R_m$ can be accurately grasped from the motor rotation signal unlimited by the number of edges in the control circuit 410 when the real rotation speed $R_m$ of the motor shaft 14 becomes a low rotation speed.

Further, in accordance with the rotation signal generating section 562, when the absolute value of the real rotation speed $R_m$ of the motor shaft 14 becomes the value $R_{mth}$ or more, the number of edges of the motor rotation signal generated by the gates 121 to 123 can be reduced to ¼. Thus, the motor rotation signal limited by the number of edges is processed in the control circuit 410 when the rotation of the motor 12 becomes a high speed by following the rotation of the engine, etc. Accordingly, in the control circuit 410, the increase in the processing amount of the motor rotation signal is restrained and the load can be reduced.

Tenth Embodiment

Figure 21:
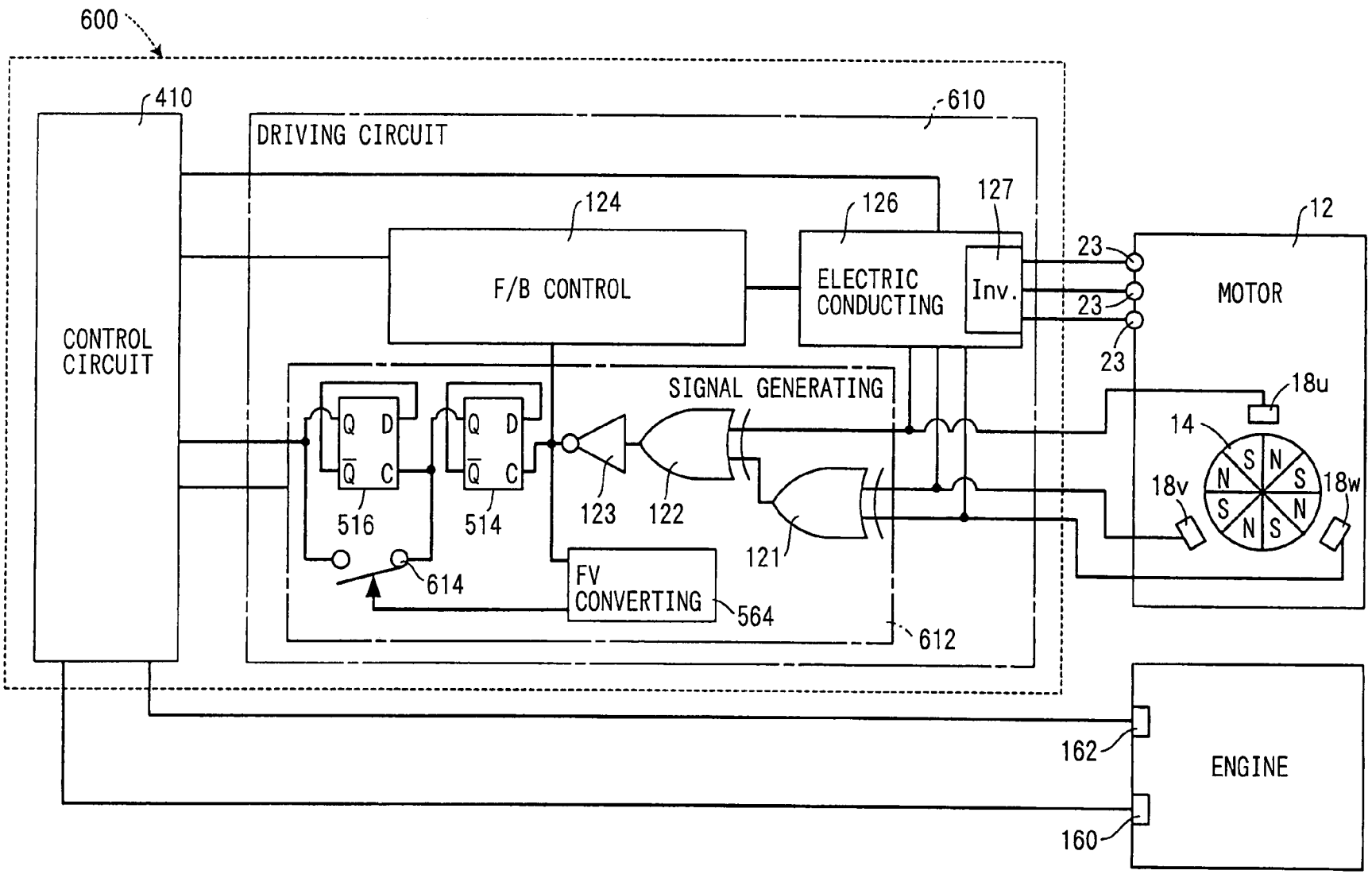
FIG. 21 is a block diagram showing a motor controller in accordance with a tenth embodiment.

As shown in FIG. 21, a tenth embodiment of the present invention is a modified example of the ninth embodiment, and the substantial same constructional portions as the ninth embodiment are designated by the same reference numerals, and their explanations are omitted.

In a motor controller 600 of the tenth embodiment, a switch section 614 of a rotation signal generating section 612 of a driving circuit 610 is arranged between the former stage D-FF 514 and the control circuit 410. This switch section 614 switches the propagating path of the motor rotation signal from the inverter gate 123 to the control circuit 410 in accordance with a switch voltage $V_s$ inputted from an FV converting section 514. Concretely, when the switch voltage $V_s$ becomes a threshold value $V_{sth}$, the switch section 614 is transferred to a turning-on state and thus propagates the motor rotation signal to the control circuit 410 by detouring the latter stage D-FF 516 via the former stage D-FF 514. Accordingly, at this time, the control circuit 410 receives the motor rotation signal in which the number of edges is reduced to half in comparison with an output time point from the inverter gate 123. In contrast to this, when the switch voltage $V_s$ becomes the threshold voltage $V_{sth}$ or more, the switch section 614 propagates the motor rotation signal from the inverter gate 123 to the control circuit 410 via the D-FFs 514, 516 by transferring the switch section 614 to a turning-off state. Accordingly, at this time, the control circuit 410 receives the motor rotation signal in which the number of edges is reduced to ¼ in comparison with the output time point from the inverter gate 123.

In accordance with such a rotation signal generating section 612, the number of edges of the motor rotation signal generated by the gates 121 to 123 can be reduced when the absolute value of the real rotation speed $R_m$ of the motor shaft 14 is less than the value $R_{mth}$ and becomes the value $R_{mth}$ or more. Therefore, the load in the control circuit 410 is reduced by a principle similar to the principle explained in the seventh embodiment. Furthermore, in the rotation signal generating section 612, when the absolute value of the real rotation speed $R_m$ becomes the value $R_{mth}$ or more, the number of edges can be reduced in comparison with the case in which the absolute value of the real rotation speed $R_m$ is less than the value $R_{mth}$. Thus, in the control circuit 410 in which the rotation of the motor 12 becomes a high speed by following the rotation of the engine, etc., the increase of the processing amount of the motor rotation signal is sufficiently restrained and the load is greatly reduced.

As mentioned above, the plural embodiments of the present invention have been explained, but the present invention is not interpreted limitedly to these embodiments.

For example, in control circuits 150, 260, 360, 410 of the first to tenth embodiments, the target rotation speed $r_m$ and the target rotating direction $d_m$ having no sign in the motor shaft 14 are determined as a control target from the phase difference between the real valve timing and the target valve timing. Thus, the target rotation speed with the sign in the motor shaft 14, a target changing amount of the rotation speed of the motor shaft 14, a target value of the load electric current in the motor 12, etc. can be illustrated as the control target able to be determined from the phase difference between the real valve timing and the target valve timing in addition to the target rotation speed $r_m$ and the target rotating direction $d_m$. Accordingly, the control circuits 150, 260, 360, 410 may be also constructed such that at least one kind selected in advance from the above illustrated values is determined as the control target, and a suitable number of control signals showing this control target are generated. In this case, one control signal may show the control target of one kind, and one control signal may also show the control targets of plural kinds.

Further, in the control circuits 150, 260 of the second to fourth embodiments, the generating system of the control signal may be also switched in accordance with the large and small relation of the real rotation speed $R_{cr}$ of the crankshaft and the reference value $R_{crs}$ similarly to the fifth embodiment. Further, in the control circuits 410 of the sixth to tenth embodiments, the generating system of the control signal may be also switched in accordance with the large and small relation of the real rotation speed $R_{ca}$ of the camshaft 11 and the reference value $R_{cas}$ similarly to the first embodiment.

Furthermore, in the control circuits 410 of the second and sixth to tenth embodiments, the first and second control signals may be also generated on the basis of the first and second engine speed signals and the motor rotation signal without depending on the real rotation speeds $R_{cr}$, $R_{ca}$ of the crankshaft and the camshaft 11. In this case, while both the first and second engine speed signals are outputted, the generation of the control signal is embodied similarly to the case in which the real rotation speed $R_{cr}$ of the sixth embodiment is the reference value $R_{crs}$ or more. Further, when at least one of the first and second engine speed signals is not outputted, the generation of the control signal is embodied similarly to the case in which the real rotation speed $R_{ca}$ of the first embodiment is less than the reference value $R_{cas}$. Thus, even when at least one of the first and second engine speed signals is not outputted, the generation of the control signal based on the remaining motor rotation signal is embodied and a suitable valve timing adjustment can be realized.

Furthermore, in the rotation signal generating sections 120 of the first, fifth and sixth embodiments and the rotation signal generating circuit 210 of the second embodiment, the motor rotation signal showing the absolute value of the real rotation speed $R_m$ of the motor shaft 14 and the rotating direction signal showing the sign of the real rotation speed $R_m$, i.e., the rotating direction of the motor shaft 14 may be separately generated and these signals may be also transmitted to control circuits 150, 360, 410. Further, in the rotation signal generating sections 462, 512, 562, 612 of the seventh to tenth embodiments, the motor rotation signal may be also transmitted to the control circuit 410 so as to further show the sign of the calculated real rotation speed $R_m$ in addition to the absolute value of the real rotation speed $R_m$ of the motor shaft 14.

In addition, in the third embodiment, the detecting signals of two or only one of the Hall effect elements 18*u*, 18*v*, 18*w* may be also transmitted to the control circuit 260 through the driving circuit 270 or without interposing the driving circuit 270. Further, in the fifth and sixth embodiments, the rotation signal generating section 120 may not be arranged similarly to the third embodiment and the detecting signal of at least one of the Hall effect elements 18*u*, 18*v*, 18*w* may be also transmitted to control circuits 260, 410 through the driving circuit 110 or without interposing the driving circuit 110.

In addition, in the fifth and sixth embodiments, the detecting signal of only one of the Hall effect elements 18*u*, 18*v*, 18*w* may be also transmitted to control circuits 360, 410 by inverting this detecting signal or without inverting this detecting signal similarly to the fourth embodiment. Further, in the fourth to tenth embodiments, similar to the second embodiment, rotation signal generating sections 312, 120, 462, 512, 562, 612 may be set to different circuits and may be also separated from driving circuits 310, 110, 460, 510, 560, 610.

Further, in addition, in the first to tenth embodiments, the three-phase brushless motor is used, but a publicly known motor except for the three-phase brushless motor may be also used. Further, in the first to tenth embodiments, the Hall element is used as a rotation position sensor, but e.g., a magnetic resistance effect element may be also used as the rotation position sensor.

Furthermore, it is desirable to arrange a suitable number of rotation position sensors according to the kind of this sensor and the kind of the motor in the rotating direction of the motor and generate the motor rotation signal of a predetermined desirable number of edges.

Further, in addition, the rotation signal generating section 462 of the seventh embodiment may also have an FV converting section 564 and a switch section 566 of a connection mode similar to that of the ninth embodiment. In this case, when the absolute value of the real rotation speed $R_m$ of the motor shaft 14 is less than the value $R_{mth}$, the motor rotation signal generated by gates 121 to 123 is transmitted to the control circuit 410 as it is. In contrast to this, when the absolute value of the real rotation speed $R_m$ becomes the value $R_{mth}$ or more, the motor rotation signal generated by the gates 121 to 123 is reduced to half in the number of edges and is transmitted to the control circuit 410. Thus, a suitable number of D-FFs for performing reduction processing of the number of edges with respect to the motor rotation signal generated by the gates 121 to 123 can be used in accordance with a reducing ratio of the calculated number of edges. Further, a suitable number of switch sections combined with the D-FF to perform addition and subtraction processings of the number of edges with respect to the motor rotation signal generated by the gates 121 to 123 can be arranged in required positions in accordance with the reducing ratio of the calculated number of edges and the number of used D-FFs. Furthermore, if it is a publicly known construction able to perform the reduction processing or the addition and subtraction processings of the number of edges with respect to the motor rotation signal generated by the gates 121 to 123, it is also possible to adopt a construction (e.g., a microcomputer) except for the construction formed by the D-FF and a switch as in the seventh to tenth embodiments.

What is claimed is:

1. A valve timing controller for controlling a valve timing of an engine by utilizing the rotation torque of a motor, comprising:

a control circuit for generating a control signal; and a driving circuit for turning-on and driving the motor in accordance with the control signal generated by the control circuit;

wherein the control circuit for receiving a motor rotation signal showing a real rotation speed or a real rotation position of the motor, and an engine speed signal showing the real rotation speed of the engine generates the control signal on the basis of the motor rotation signal when the real rotation speed of the engine is less than a reference value, and the control circuit also generates the control signal on the basis of the engine speed signal when the real rotation speed of the engine becomes the reference value or more.

2. A valve timing controller for controlling a valve timing of an engine by utilizing the rotation torque of a motor, comprising:

a control circuit for generating a control signal; and a driving circuit for turning-on and driving the motor in accordance with the control signal generated by the control circuit;

wherein the control circuit for receiving a motor rotation signal showing a real rotation speed or a real rotation position of the motor, and an engine speed signal showing the real rotation speed of the engine generates the control signal on the basis of the motor rotation signal when the real rotation speed of the engine is less than a reference value, and the control circuit also generates the control signal on the basis of the engine speed signal and the motor rotation signal when the real rotation speed of the engine becomes the reference value or more.

3. The valve timing controller according to claim 1, wherein the control circuit receives a detecting signal of a rotation speed sensor for detecting the real rotation speed of the engine as the engine speed signal, and the reference value is set to a value equal to or greater than a detecting lower limit value of the rotation speed sensor.

4. The valve timing controller according to claim 1, wherein the driving circuit generates the motor rotation signal showing the real rotation speed of the motor on the basis of a detecting signal of a rotation position sensor for detecting the real rotation position of the motor, and the control circuit receives the motor rotation signal generated by the driving circuit.

5. The valve timing controller according to claim 4, wherein the driving circuit generates the motor rotation signal on the basis of the detecting signals of a plurality of the rotation position sensors.

6. The valve timing controller according to claim 5, wherein the driving circuit receives the detecting signal switched in a voltage level at different timings in accordance with the real rotation position of the motor from a plurality of the rotation position sensors, and generates the motor rotation signal switched in the voltage level every time an edge appears in one of these detecting signals.

7. The valve timing controller according to claim 2, wherein the control circuit receives a detecting signal of a rotation speed sensor for detecting the real rotation speed of the engine as the engine speed signal, and the reference value is set to a value equal to or greater than a detecting lower limit value of the rotation speed sensor.

8. The valve timing controller according to claim 2, wherein the driving circuit generates the motor rotation signal showing the real rotation speed of the motor on the basis of a detecting signal of a rotation position sensor for detecting the real rotation position of the motor, and the control circuit receives the motor rotation signal generated by the driving circuit.

9. The valve timing controller according to claim 8, wherein the driving circuit generates the motor rotation signal on the basis of the detecting signals of a plurality of the rotation position sensors.

10. The valve timing controller according to claim 9, wherein the driving circuit receives the detecting signal switched in a voltage level at different timings in accordance with the real rotation position of the motor from a plurality of the rotation position sensors, and generates the motor rotation signal switched in the voltage level every time an edge appears in one of these detecting signals.

11. The valve timing controller according to claim 10, wherein the driving circuit transmits the generated motor rotation signal to the control circuit by reducing a number of edges.

12. The valve timing controller according to claim 10, wherein the driving circuit transmits the motor rotation signal to the control circuit as it is when the absolute value of the real rotation speed of the motor shown by the generated motor rotation signal is less than a threshold value, and the driving circuit reduces a number of edges with respect to the motor rotation signal and transmits this motor rotation signal to the control circuit when the absolute value of the real rotation speed of the motor shown by the generated motor rotation signal becomes the threshold value or more.

13. The valve timing controller according to claim 10, wherein the driving circuit reduces a number of edges with respect to the motor rotation signal and transmits this motor rotation signal to the control circuit when the absolute value of the real rotation speed of the motor shown by the generated motor rotation signal is less than a threshold value, and the driving circuit reduces the number of edges in comparison with the case of the absolute value less than the threshold value with respect to the motor rotation signal, and transmits this motor rotation signal to the control circuit when the absolute value of the real rotation speed of the motor shown by the generated motor rotation signal becomes the threshold value or more.

14. The valve timing controller according to claim 1, wherein the control circuit receives a detecting signal of a rotation position sensor for detecting the real rotation position of the motor as the motor rotation signal showing the real rotation position of the motor.

15. The valve timing controller according to claim 1, wherein the control circuit has a function for controlling the operation of the engine.

16. A method for controlling valve timing of an engine by utilizing the rotation torque of a motor, said method comprising:

turning-on and driving said motor in accordance with a control signal;

generating said control signal on the basis of (a) a motor rotation signal showing a real rotation speed or a real rotation position of the motor when the real rotation speed of the engine is less than a reference value and (b) an engine speed signal showing the real rotation speed of the engine on the basis of the motor rotation signal when the real rotation speed of the engine becomes equal to or greater than the reference value.

17. A method as in claim 16 wherein the control signal is generated on the basis of the engine speed signal and the motor rotation signal when the real rotation speed of the engine becomes equal to or greater than said reference value.

* * * * *